US007686669B2

(12) United States Patent
Sun et al.

(10) Patent No.: US 7,686,669 B2
(45) Date of Patent: Mar. 30, 2010

(54) ACCESSORIES FOR TOY FIGURES

(75) Inventors: Steed Sun, San Gabriel, CA (US); Ruben Martinez, Whittier, CA (US); Peter Fan, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 928 days.

(21) Appl. No.: 11/448,522

(22) Filed: Jun. 6, 2006

(65) Prior Publication Data

US 2006/0292963 A1 Dec. 28, 2006

Related U.S. Application Data

(60) Provisional application No. 60/687,936, filed on Jun. 6, 2005, provisional application No. 60/687,998, filed on Jun. 6, 2005, provisional application No. 60/733,555, filed on Nov. 4, 2005.

(51) Int. Cl.
*A63H 3/00* (2006.01)

(52) U.S. Cl. ..... 446/268; 446/175; 446/297; 446/405; 446/473

(58) Field of Classification Search ..... 446/268, 446/297, 327, 330, 359, 352, 399–401, 405, 446/397

See application file for complete search history.

(56) References Cited

U.S. PATENT DOCUMENTS

| | | | | |
|---|---|---|---|---|
| 2,211,105 | A | 8/1940 | Dunn | |
| 3,127,176 | A | 3/1964 | Ryan | |
| 3,614,110 | A | 10/1971 | Marshall et al. | |
| 3,808,736 | A | 5/1974 | Terzian et al. | |
| 3,911,613 | A | 10/1975 | Morrison et al. | |
| 3,925,924 | A | 12/1975 | Schoenfield | |
| 3,958,118 | A | 5/1976 | Schwarz | |
| 4,060,929 | A | 12/1977 | Meyer et al. | |
| 4,185,412 | A | 1/1980 | Rahmstorf | |
| 4,254,451 | A | 3/1981 | Cochran, Jr. | |
| 4,606,618 | A * | 8/1986 | Geller | 359/408 |
| 4,626,222 | A | 12/1986 | Sweet | |
| 4,637,007 | A | 1/1987 | Sakurai | |
| 4,703,573 | A | 11/1987 | Montgomery et al. | |
| 4,723,931 | A | 2/1988 | Allen et al. | |
| 4,874,343 | A | 10/1989 | Rosenthal | |
| 4,902,262 | A | 2/1990 | Lunsford | |
| 4,982,176 | A | 1/1991 | Schwarz | |
| 5,037,345 | A | 8/1991 | Nakayama | |

(Continued)

FOREIGN PATENT DOCUMENTS

| | | |
|---|---|---|
| EP | 0482887 | 4/1992 |

(Continued)

*Primary Examiner*—Peter DungBa Vo
*Assistant Examiner*—Alex F. R. P. Rada, II
(74) *Attorney, Agent, or Firm*—Kolisch Hartwell, P.C.

(57) ABSTRACT

The present disclosure is directed to an accessory for a toy figure having at least one receptacle and to a play kit. The accessory includes a housing configured to be selectively attached to the at least one receptacle of the toy figure. In some embodiments, the accessory includes an audio input mechanism; an audio processing mechanism; and an audio output mechanism. In some embodiments, the accessory includes a motion detector mechanism and an audio output mechanism. In some embodiments, the accessory includes an optical assembly. In some embodiments, the play kit includes a toy figure having at least one receptacle; a key; a first accessory; and a second accessory.

20 Claims, 17 Drawing Sheets

U.S. PATENT DOCUMENTS

| | | | | |
|---|---|---|---|---|
| 5,073,140 | A | 12/1991 | Lebensfeld et al. | |
| 5,092,810 | A | 3/1992 | Kwan et al. | |
| 5,147,237 | A | 9/1992 | Kwan et al. | |
| 5,364,107 | A | 11/1994 | Kinkead | |
| 5,730,638 | A | 3/1998 | Ward | |
| 6,069,958 | A | 5/2000 | Weisel | |
| 6,071,166 | A * | 6/2000 | Lebensfeld et al. | 446/175 |
| 6,089,942 | A | 7/2000 | Chan | |
| 6,116,744 | A | 9/2000 | Batterman | |
| D437,012 | S | 1/2001 | Crawford | |
| 6,171,168 | B1 * | 1/2001 | Jessop | 446/297 |
| 6,824,442 | B2 | 11/2004 | Andrews et al. | |
| 2003/0067385 | A1 | 4/2003 | Shank et al. | |
| 2003/0220044 | A1 * | 11/2003 | Andrews et al. | 446/268 |
| 2004/0212148 | A1 | 10/2004 | Losey et al. | |
| 2005/0096111 | A1 | 5/2005 | Beck | |
| 2005/0146457 | A1 | 7/2005 | Apostolos | |

FOREIGN PATENT DOCUMENTS

| | | |
|---|---|---|
| GB | 1549964 | 8/1979 |
| GB | 2180768 | 4/1987 |
| WO | WO98/50126 | 11/1998 |

* cited by examiner

Fig. 35
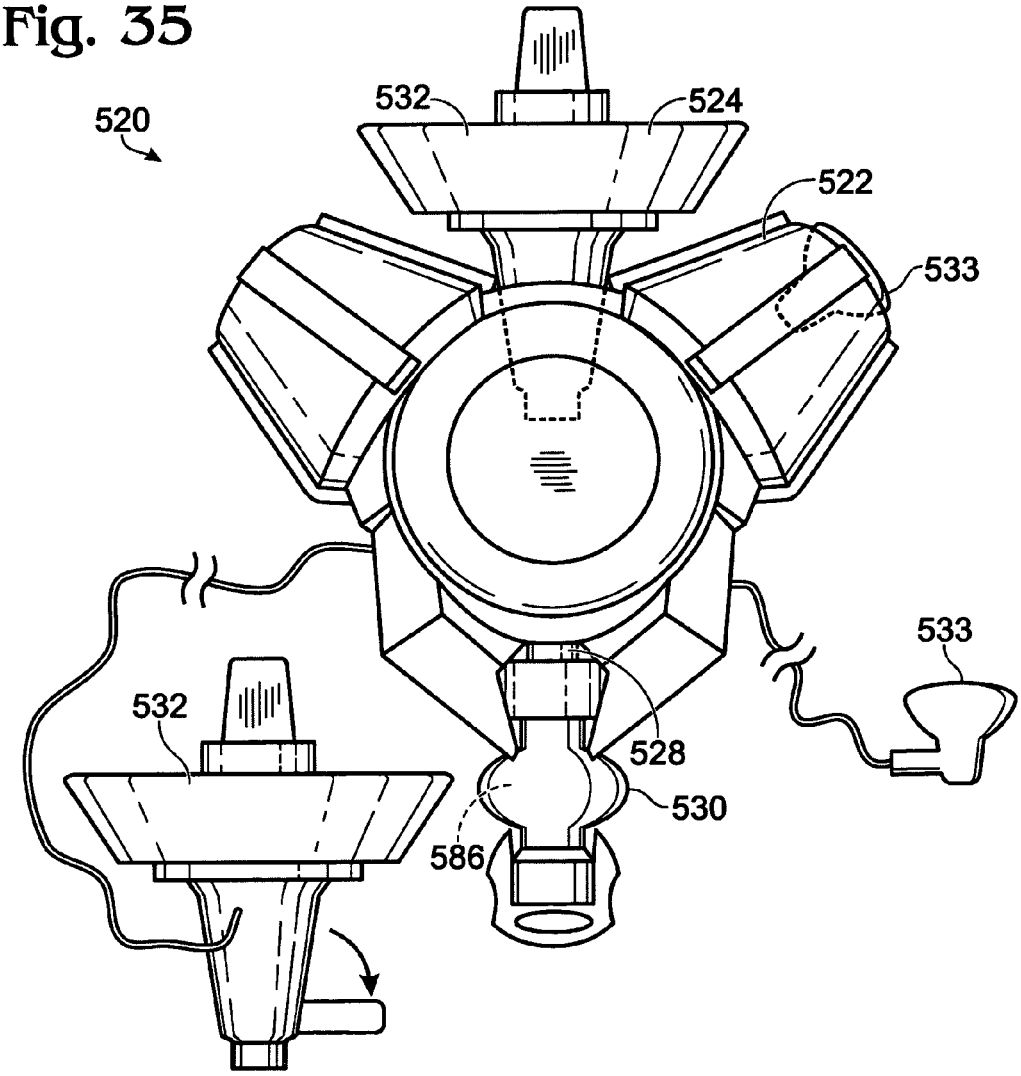
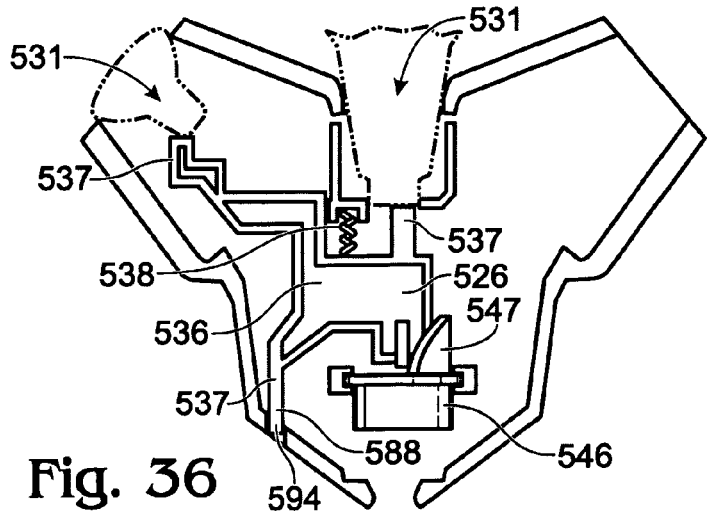
Fig. 36

ACCESSORIES FOR TOY FIGURES

CROSS REFERENCE TO RELATED APPLICATIONS

This application claims priority under 35 U.S.C. §119(e) to U.S. Provisional Patent Application Ser. No. 60/687,936 entitled "Accessories for Toy Figures," filed Jun. 6, 2005; U.S. Provisional Application Ser. No. 60/687,998 entitled "Toy Figure with Magnets," filed Jun. 6, 2005; and U.S. Provisional Application Ser. No. 60/733,555 entitled "Toy Figure with Magnets," filed Nov. 4, 2005. The complete disclosure of the above applications are hereby incorporated by reference for all purposes.

BACKGROUND OF THE DISCLOSURE

The present disclosure is directed to accessories for toy figures, including battery-powered accessories for toy figures, and play kits including toy figures and accessories for toy figures.

Examples of accessories, including accessories for toy figures are found in U.S. Pat. Nos. 6,824,442; 6,071,166; 5,730,638; 5,364,107; 5,147,237; 5,092,810; 5,073,140; 4,902,262; 4,874,343; 4,723,931; 4,637,007; 4,626,222; 4,185,412; 4,060,929; 3,925,924; 3,911,613; 3,808,736; 3,911,613; 3,614,110; 3,127,176; 2,211,105; and D437,012; U.S. Patent Application Publication Nos. US 2005/0096111 and US 2004/0212148; European Patent Application No. 0482887; PCT Application Publication No. WO 98/50126; and United Kingdom Patent Application Nos. 2,180,768 and 1,549,964, the entire disclosures of the above patents and patent applications are herein incorporated by reference for all purposes.

SUMMARY OF THE DISCLOSURE

Some embodiments provide an accessory for a toy figure having at least one receptacle. The accessory including a housing configured to be selectively attached to the at least one receptacle of the toy figure; an audio input mechanism operatively attached to the housing and configured to receive one or more sounds; an audio processing mechanism configured to process the one or more sounds received from the audio input mechanism; and an audio output mechanism configured to output the processed one or more sounds from the audio processing mechanism.

Some embodiments provide an accessory for a toy figure having at least one receptacle. The accessory including a housing configured to be selectively attached to the at least one receptacle of the toy figure; a motion detector mechanism operatively attached to the housing and configured to detect movement of an object in a detection zone; and an audio output mechanism configured to output one or more sounds responsive, at least in part, to the motion detector mechanism detecting movement of the object.

Some embodiments provide an accessory for a toy figure having at least one receptacle. The accessory including a housing configured to be selectively attached to the at least one receptacle of the toy figure; and an optical assembly operatively attached to the housing, the optical assembly including two or more mechanical members each having at least one lens, wherein the two or more mechanical members are selectively movable between a deployed position in which the lenses are adjacent to each other, and a retracted position in which the lenses are spaced apart from each other.

Some embodiments provide a play kit. The play kit including a toy figure having at least one receptacle; a key; a first accessory configured to be selectively attached to the at least one receptacle of the toy figure, the first accessory including one or more first mechanical members configured to move between a first position and a second position and a first key receiver assembly configured to be moved at least by the key to move the one or more first mechanical members between the first and second positions; and a second accessory configured to be selectively attached to the at least one receptacle of the toy figure, the second accessory including one or more second mechanical members configured to move between a third position and a fourth position and a second key receiver assembly configured to be moved at least by the key to move the one or more second mechanical members between the third and fourth positions.

BRIEF DESCRIPTION OF THE DRAWINGS

FIG. 35 is a front view of another example of an accessory showing mechanical members in attached and detached positions.

FIG. 36 is a front partial sectional view of the accessory of FIG. 35 shown without a key and showing a front half with securing members in a securing position.

DETAILED DESCRIPTION OF THE DISCLOSURE

Figure 1:
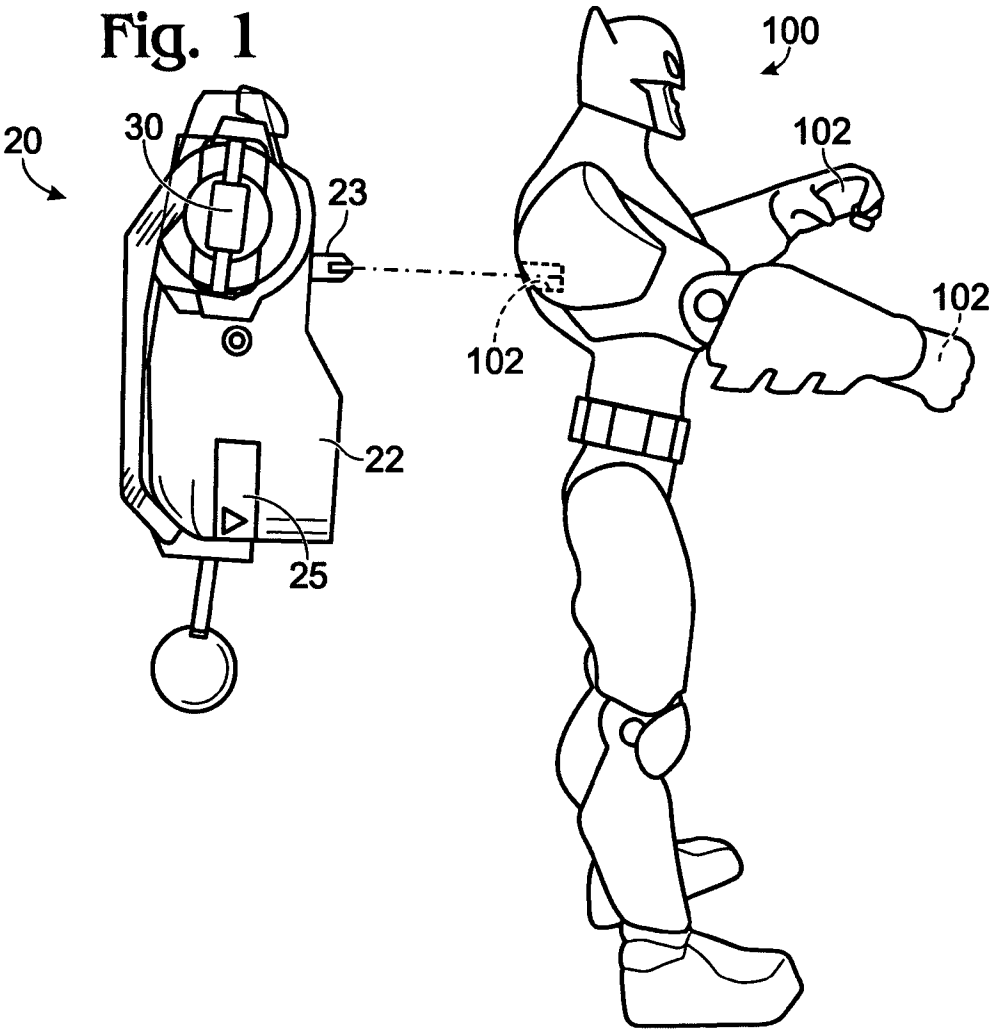
FIG. 1 is a side view of some embodiments of an accessory and a toy figure.

Referring to FIG. 1, some embodiments of an accessory 20 are shown attached to a toy figure 100. The toy figure may be any suitable toy figure. The toy figure may have any suitable number of limbs and/or any suitable point(s) of articulation. Additionally, toy figure 100 may have one or more connecting portions or receptacles 102 configured to receive one or more of accessory 20. The connecting portions may include cavities, protrusions, grooves, hooks, latches, magnets, steel and/or iron components, and/or other suitable receptacles.

Although toy figure 100 is shown to have cavities for receptacle 102, the toy figure may additionally, or alternatively, have any suitable type(s) of connecting portions such as cavities, protrusions, grooves, hooks, latches, magnets, steel and/or iron components. Additionally, although the toy figure is shown to include three receptacles (on the back and the two receptacles formed by the hands), the toy figure may have any suitable number of receptacles. Moreover, although the toy figure is shown to have receptacles in specific locations, the toy figure may have receptacles in any suitable locations. For example, the toy figure may additionally, or alternatively, have receptacles on the head, leg(s), arm(s), etc. Furthermore, although a particular toy figure is shown, any suitable toy figure may be used. Additionally, although accessory 20 is shown attached to a toy figure, the accessory may be attached to any suitable base toy, such as toy vehicles, toy stations, etc.

Figure 2:
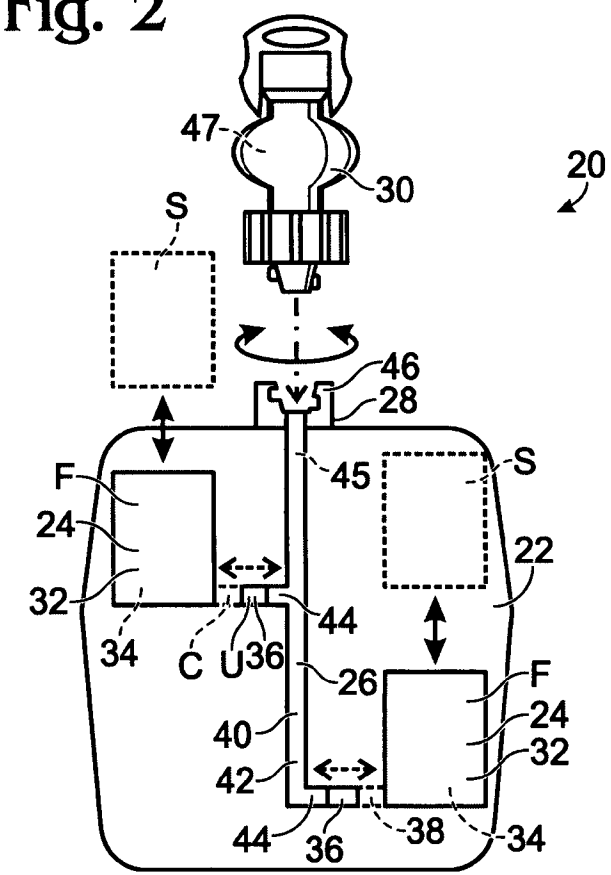
FIG. 2 is a schematic view of the accessory of FIG. 1.

Accessory 20 may include a body or housing 22, one or more mechanical assemblies 24, one or more securing mechanisms 26, one or more key receiver assemblies 28, and one or more keys 30, as shown schematically in FIG. 2. The housing may include one or more connecting portions 23 and one or more actuators 25, as shown in FIG. 1. The connecting portions may include cavities, protrusions, grooves, hooks, latches, magnets, steel and/or iron components, and/or other suitable receptacles configured to allow the housing to be selectively attached to at least one of the receptacles of the toy figure. The actuators may include any suitable structure, such as buttons, cords, levers, etc., configured to provide input(s) to an electrical system of the accessory. Additionally, housing 22 may be any suitable material and resemble any suitable accessory. For example, housing 22 may resemble a backpack, a vehicle, a base station, a monitoring station, etc.

Although housing 22 is shown to include a protrusion for connecting portion 23, the housing may include any suitable type(s) of connecting portions. Additionally, although housing 22 is shown to include one connecting portion 23 and one actuator 25, the housing may include any suitable number of connecting portions and/or actuators.

Mechanical assemblies 24 may be operatively connected to the housing and may include any suitable structure configured to move in any suitable way(s). For example, the mechanical assemblies may include one or more mechanical members 32 and one or more bias elements 34, as shown in FIG. 2. The members may resemble any suitable subparts of the accessory. For example, the members may include face guard(s), antenna, stand(s), projectile launcher(s), earphone (s), microphone(s), wing(s), lens(es), light(s), etc.

Although two members 32 are schematically shown, any suitable number of the members may be included with accessory 20. Additionally, although members 32 are schematically shown to be operatively connected to the housing at particular portions or locations, the members may be operatively connected at any suitable portions or locations of the housing.

The members may be configured to move in any suitable way. For example, members 32 may slide, rotate, pivot, detach (and attach), etc. Additionally, members 32 may be configured to move among a plurality of suitable positions, such as a first position F and a second position S, as shown in FIG. 2. For example, the members may move among retracted, intermediate, extended, attached, and/or detached positions.

Although members 32 are schematically shown to move between a first position and a second position, the members may be configured to move among any suitable number of positions. Additionally, although the members are shown to move linearly among the positions, the members may alternatively, or additionally, be configured to move nonlinearly among the positions.

Figure 3:
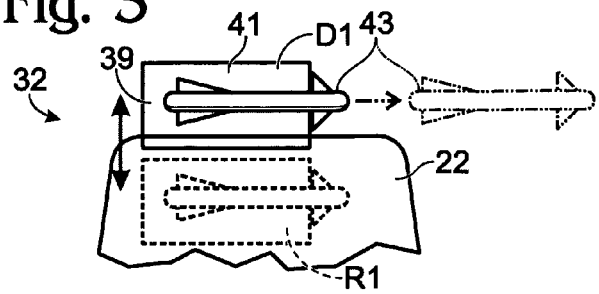
FIG. 3 is a schematic view of an example of a mechanical member of the accessory of FIG. 1.

Moreover, the members may be in any suitable form. For example, the members may form a projectile launcher assembly 39 shown in FIG. 3. The projectile launcher assembly may include any suitable structure configured to launch one or more projectiles. For example, the projectile launcher assembly may include one or more launchers 41 and one or more projectiles 43. The launcher may be configured to move between a deployed position D1 in which the projectile(s) may be launched, and a retracted position R1 in which the projectile(s) (and/or actuators to launch the projectiles) may be obstructed.

Figure 4:
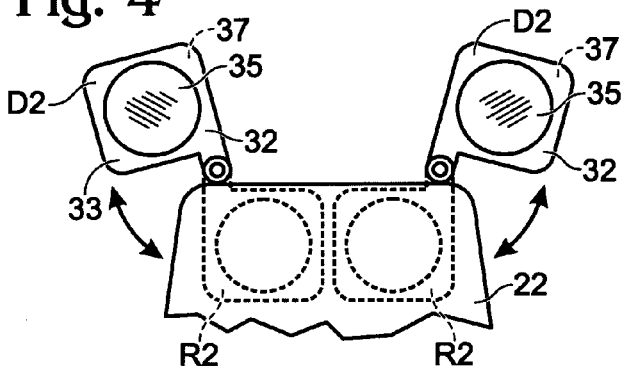
FIG. 4 is a schematic view of another example of mechanical members of the accessory of FIG. 1.
Figure 5:
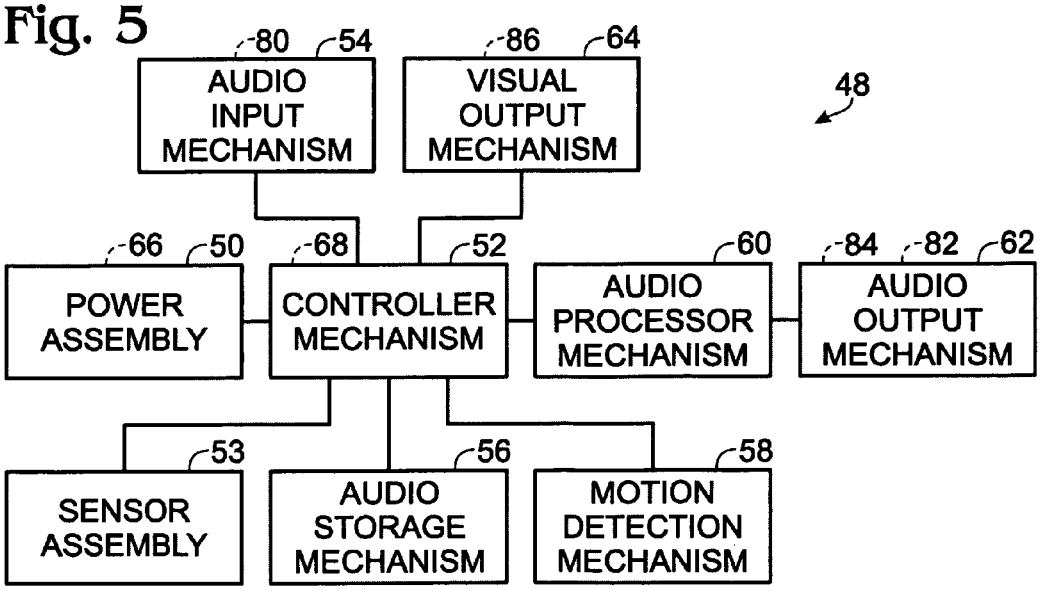
FIG. 5 is a schematic view of an electrical system of the accessory of FIG. 1.

Additionally, the members may form an optical assembly 33, which may be operatively attached to the housing, is shown in FIG. 4. The optical assembly includes two members 32 each having one or more lenses 35 and at least one light 37. The two members are configured to move between a deployed position D2 in which the lenses are adjacent to each other, and a retracted position R2 in which the lenses are spaced from each other. Optical assembly 33 may be used to provide night-vision and/or simulated night-vision capability.

Bias elements 34 may include any suitable structure configure to urge one or more of the members towards one or more of the plurality of positions, such as towards the first position. For example, bias elements 34 may include coil springs, leaf springs, music wire, and/or any suitable elastic material. Although mechanical assemblies 24 is shown to include members 32 and bias elements 34, the assemblies may include any suitable structure configured to move in any suitable way(s) and/or to resemble any suitable subpart(s) of the accessory. For example, the mechanical assemblies may include member holders configured to secure members 32 in one or more of the plurality of positions.

Securing mechanisms 26 may include any suitable structure configured to secure one or more of members 32 in one or more of the plurality of positions. For example, securing mechanisms 26 may include one or more securing members 36, one or more bias elements 38, and one or more actuator assemblies 40. The securing members may include any suitable structure configured to secure one or more of mechanical members 32. For example, securing members 36 may include hooks, latches, clamps, protrusions, cavities, grooves, etc. Securing members 36 may secure one or more of the mechanical members to one or more of the plurality of positions of the mechanical members. For example, securing members 36 may secure one or more of the mechanical members to the first position.

Securing members 36 may be configured to move between a securing position C in which the mechanical member(s) are secured to one or more of the plurality of positions of the mechanical member(s), and an unsecuring position U in which the securing members are spaced from the mechanical member(s) allowing the mechanical member(s) to be moved to the other of the plurality of positions and/or to allow bias elements 34 to urge the mechanical members to one or more of the plurality of positions associated with the mechanical members. The securing members may slide, rotate, pivot, and/or move any suitable way.

Although securing members 36 are shown to move linearly, the securing members may additionally, or alternatively, move nonlinearly. Additionally, although the securing mechanism includes at least one securing member for each mechanical member 32, the securing mechanism may include securing members that are more or less than the mechanical members.

Bias elements 38 may include any suitable structure configured to urge securing members 36 toward the securing position and/or unsecuring position. For example, bias elements 38 may include coil springs, leaf springs, music wire, and/or any suitable elastic material. Actuator assemblies 40 may include any suitable structure configured to move securing members 36 to the unsecuring position or the securing position. For example, actuator assemblies 40 may include a shaft 42, one or more engagement members 44, and one or more bias elements 45.

Shaft 42 may be configured to be moved by key receiver assemblies 28. Shaft 42 may be any suitable shape(s). Engagement members 44 may be configured to move the securing members between the securing and unsecuring positions. Bias elements 45 may urge the shaft and/or engagement members away from moving the securing members to the unsecuring position.

Although actuator assemblies 40 are schematically shown to include a single shaft 42, the actuator assemblies may include any suitable number of shafts. Additionally, although shaft 42 is shown to be rotated, the shaft may be moved in any suitable to move securing members 36 to the unsecuring position and/or the securing position. Moreover, although the actuator assemblies are shown to include engagement members 44 separate from the securing members, the engagement members may be incorporated with the securing members.

Engagement members 44 may be attached to shaft 42 and may be configured to move securing members 36 to the unsecuring position, which may be against the urging of bias elements 38. Alternatively, engagement members 44 may be configured to move securing members 36 to the securing position, which may be against the urging of bias elements 38.

Although actuator assemblies 40 are schematically shown to include two engagement members 44, the actuator assemblies may include any suitable number of engagement members. Additionally, although securing mechanisms 26 are shown to include securing members 36, bias elements 38, and actuator assemblies 40, the securing mechanisms may include any suitable structure configured to secure one or more of members 32 in one or more of the plurality of positions.

Key receiver assemblies 28 may include any suitable structure configured to receive one or more keys 30 and/or to move shaft 42, engagement members 44, and/or any suitable part(s) of actuator assemblies 40. For example, the key receiver assemblies may include one or more key receptacles 46. The key receptacles may be operatively connected to shaft 42 such that turning the key 30 moves the shaft and the engagement members. The key receiver assemblies may be in electrical communication with a power assembly to provide electrical power to one or more lights that may be contained in and/or associated with the key and/or the key receiver assemblies.

Although only a single key receiver assembly 28 is shown, accessory 20 may include any suitable number of key receiver assemblies. For example, two or more key receiver assemblies may be operatively connected to different sets of engagement members 44 of securing mechanisms 26. Additionally, although the key receiver assembly is shown to receive a single key, the key receiver assembly may be configured to receive any suitable number of keys. For example, different keys may be operatively connected to different sets of engagement members 44 of the securing mechanisms.

Moreover, although key receiver assemblies 28 are shown to include key receptacles 46, the key receiver assemblies may include any suitable structure configured to receive one or more keys 30 and/or to move shaft 42, engagement members 44, and/or any suitable part(s) of actuator assemblies 40. Furthermore, although key receiver assemblies 28 are shown to accept a particular key, the key receiver assemblies may be configured to accept any suitable type(s) of keys. For example, the key receiver assemblies may be configured to receive a portion of a household item (such as a tip of a pen or pencil) for when a user loses the key of the accessory.

Keys 30 may include any suitable structure configured to be received by the key receiver assemblies and/or to be operatively connected to the engagement members of the securing mechanisms. The keys may be any suitable material(s) and/or shape(s). Additionally, the keys may include one or more lights 47. Although a particular key is depicted, the key may include any suitable structure configured to be received by the key receiver assemblies and/or to be operatively connected to the engagement members of the securing mechanisms.

Although accessory 20 is shown to include a housing 22, mechanical assemblies 24, securing mechanisms 26, key receiver assemblies 28, and keys 30, the accessory may have one or more functions associated with those part(s) incorporated with other parts. For example, at least some of the components and/or associated functions of the components of the securing mechanisms may be incorporated into the components of the key receiver assemblies, such as the key receptacle moving the securing members between the securing and unsecuring positions.

Accessory 20 also may include an electrical system 48, which may include any suitable structure configured to produce and/or generate audio and/or visual output. For example, electrical system 48 may include a power assembly 50, a controller mechanism 52, a sensor assembly 53, an audio input mechanism 54, an audio storage mechanism 56, a motion detector mechanism 58, an audio processor mechanism 60, an audio output mechanism 62, and a visual output mechanism 64. One or more of the components of the electrical system may be operatively attached to the housing of accessory 20.

Power assembly 50 may include any suitable structure configured to provide electrical power to one or more of the other components of the electrical system. For example, power assembly may include one or more batteries 66. Although power assembly 50 is shown to include batteries 66, the power assembly may include any suitable structure configured to provide electrical power to one or more of the other components of the electrical system. For example, power assembly 50 may include suitable structure configured to provide electrical power from a utility grid and/or from other sources such as solar, wind, geothermal, nuclear, etc.

Controller mechanism 52 may include any suitable structure configured to receive inputs from one or more of the other electrical components and/or generate outputs via one or more of the other electrical components. For example, controller mechanism 52 may include a controller or microprocessor 68. Although controller mechanism 52 is shown to include the controller, the controller mechanism may include any suitable structure configured to receive inputs from one or more other electrical components and/or generate outputs via of the other electrical components. For example, controller mechanism 52 may include "hard" wiring or circuitry between input and output devices.

Sensor assembly 53 may include any suitable structure configured to be actuated by one or more of actuators to provide suitable input for the controller mechanism. The actuators may be attached in any suitable portion(s) of the housing and/or may be incorporated in one or more of the mechanical members.

Audio input mechanism 54 may include any suitable structure configured to receive any suitable type(s) of audio input, such as one or more sounds (which may include sound effects, speech phrases, and/or other sounds). For example, audio input mechanism 54 may include at least one microphone 80. The microphone may be contained in and/or associated with any suitable portion(s) of the accessory. For example, the microphone may be contained in one or more of the mechanical members, the key and/or key receiver assembly, and/or the housing. Although audio input mechanism 54 is shown to include the microphone, the audio input mechanism may include any suitable structure configured to receive any suitable type(s) of audio input(s).

Audio storage mechanism 56 may include any suitable structure configured to store audio input(s) received via the audio input mechanism. For example, audio storage mechanism may include one or more audio tapes, digital tapes, compact disks, digital video disks, etc. Although audio storage mechanism 56 is discussed to include particular types of audio storage device(s), the audio storage mechanism may include any suitable types of audio storage device(s).

Figure 6:
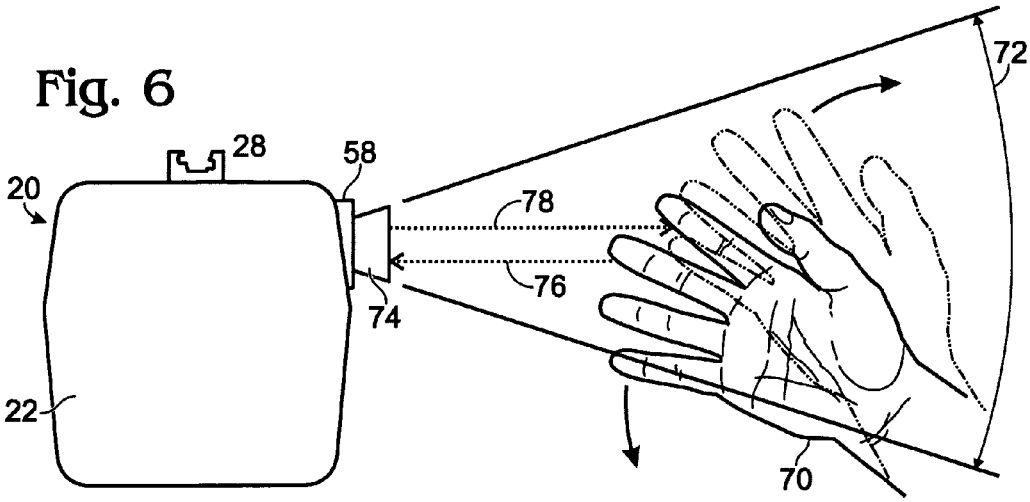
FIG. 6 is a schematic view of a motion detector mechanism of the accessory of FIG. 1.

Motion detector mechanism 58 may include any suitable structure configured to detect movement of one or more objects and/or persons (or portion(s) of objects and/or persons) 70 in one or more detection zones 72, as shown in FIG. 6. For example, the motion detector mechanism may include one or more sensors 74. Any suitable type(s) of sensors may be used. For example, sensors 74 may be "active" sensors, which inject energy waves 76 (such a light, microwave, or sound) into the detection zone and measure reflected energy waves 78 to detect any suitable change in the reflected energy waves. Alternatively, or additionally, "passive" sensors may be used that detects infrared energy and/or other forms of energy in the detection zone to detect movement of an object or person.

The sensors may be contained in and/or associated with any suitable portion(s) of accessory 20. For example, sensors 74 may be contained within and/or associated with one or more of the mechanical members, the key and/or key receiver assembly, and/or the housing. Although motion detector mechanism 58 is shown to include sensors 74, the motion detector mechanism may include any suitable structure configured to detect movement of one or more objects and/or persons.

Audio processor mechanism 60 may include any suitable structure configured to change one or more characteristics of the one or more sounds received via audio input mechanism 54. The characteristics changed may include one or more of volume, timbre, tone, formant, reverberation, pitch, and other suitable characteristics of the audio input(s).

Audio output mechanism 62 may include any suitable structure configured to output one or more sounds. For example, audio output mechanism 62 may include one or more earphones 82 and one or more speakers 84. The one or more sounds may be sounds processed via the audio processing mechanism, sounds stored in the audio storage mechanism, and/or any suitable source. Additionally, the audio output-mechanism may generate one or more sounds responsive, at least in part, to the motion detector mechanism detecting movement of the object, one or more of the actuators of the accessory are actuated, etc.

The earphone and/or the speaker may be contained in and/or associated with any suitable portion(s) of accessory 20. For example, the earphone and the speaker may be contained within and/or associated with one or more of the mechanical members, the key and/or key receiver assembly, and/or may be attached to the housing. Although the audio output mechanism is shown to include earphones and speakers, the audio output mechanism may include any suitable structure configured to output one or more sounds.

Visual output mechanism 64 may include any suitable structure configured to generate one or more visual outputs. For example, the visual output mechanism may include one or more lights 86. The lights may be contained in and/or associated with any suitable portion(s) of the accessory. For example, the lights may be contained in and/or associated with one or more of the mechanical members (such as adjacent each lens of the optical assembly), the key and/or the key receiving assembly, and/or the housing.

The lights may be illuminated responsive, at least in part, to the sound processing mechanism processing the one or more sounds, the key receiver assembly receiving the key, the audio input mechanism receiving audio input, the audio output mechanism generating audio output, one or more of the members being moved, etc. Although the visual output mechanism is shown to include one or more lights, the visual output mechanism may include any suitable structure configured to generate one or more visual outputs. For example, visual output mechanism 64 may include video output. Additionally, although electrical system 48 of accessory 20 is shown to include particular components, the electrical system may include any suitable components configured to produce or generate audio and/or visual output.

Figure 7:
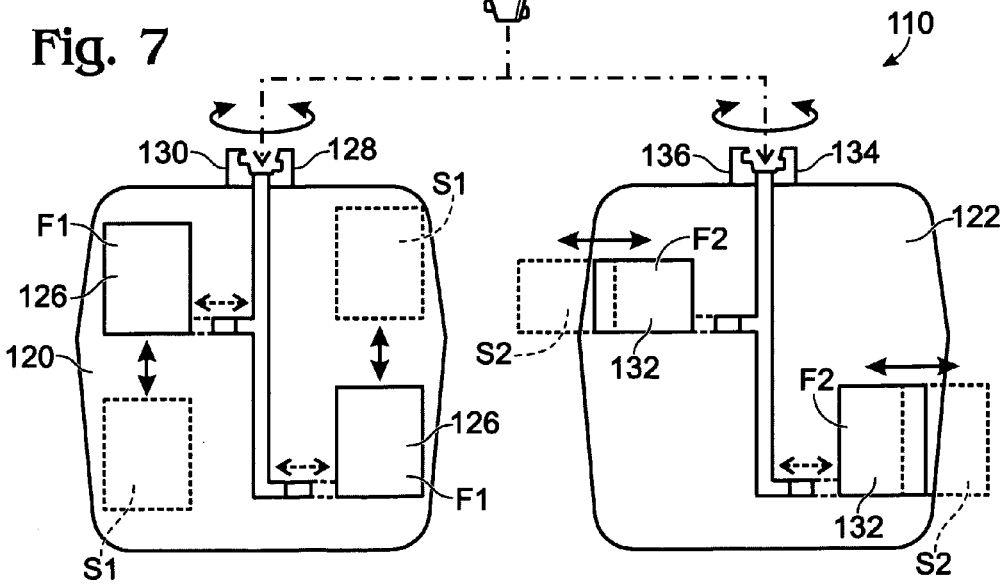
FIG. 7 is a schematic view of a play kit including two accessories and a key.

At least some of the structure(s) disclosed in this patent application may be part of a play kit 110. For example, the play kit may include toy figure 100 (such as the toy figure shown in FIG. 1), a first accessory 120, a second accessory 122, and a key 124, as shown in FIG. 7. The first accessory may be configured to be selectively attached to the toy figure and include one or more first mechanical members 126 and a first key receiver assembly 128. The first mechanical members may be configured to among a plurality of positions, such as a first position F1 and a second position S1. The first key receiver assembly may include a key receptacle 130, which may be configured to receive key 124 and be moved by at least the key to move the one or more first mechanical members between the first and second positions.

The second accessory may be configured to be selectively attached to the toy figure and include one or more second mechanical members 132 and a second key receiver assembly 134. The second mechanical members may be configured to among a plurality of positions, such as a first position F2 and a second position S2. The second key receiver assembly may include a key receptacle 136, which may be configured to receive key 124 and be moved by at least the key to move the one or more second mechanical members between the first and second positions.

Key 124 may be configured to be received by the key receptacles of the first and second accessories. Although play kit 110 is shown to include a toy figure, first and second accessories, and a key, the play kit may include any suitable combination of the structure(s) and/or feature(s) disclosed in this patent application. For example, the play kit may include additional accessories and/or additional toy figures.

FIGS. 8-14 illustrate an example of accessory 20 generally indicated at 220. Unless otherwise indicated, the accessory may have at least some of the components of the accessory 20 discussed above. Accessory 220 may include a housing 222, a mechanical assembly 224, a securing mechanism 226, a key receiver assembly 228, and a key 230.

Figure 9:
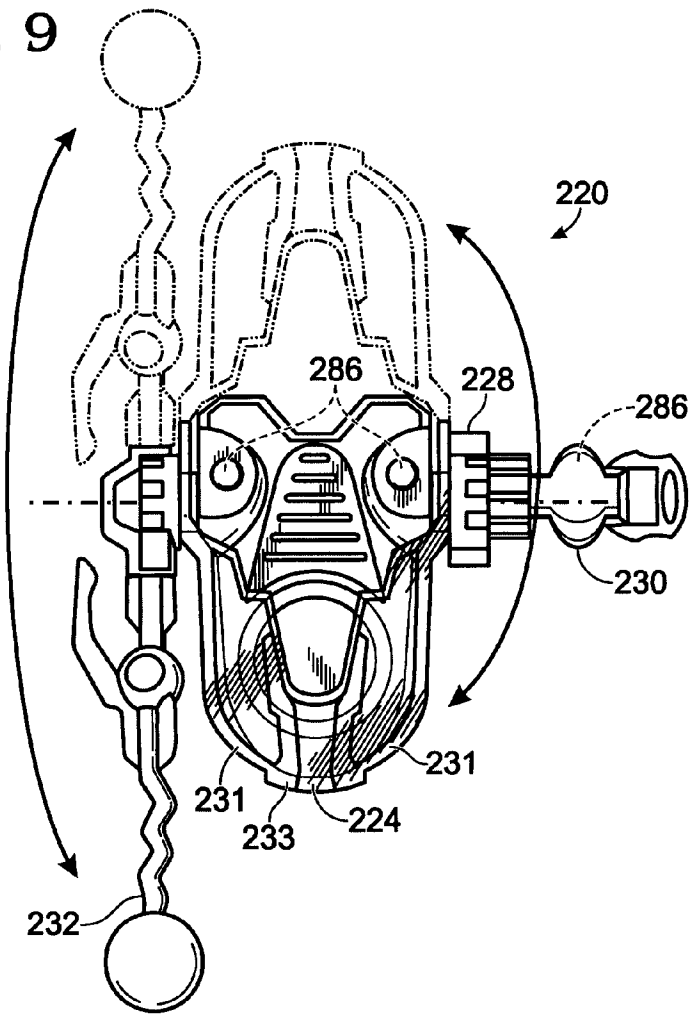
FIG. 9 is a front view of the accessory of FIG. 8.
Figure 8:
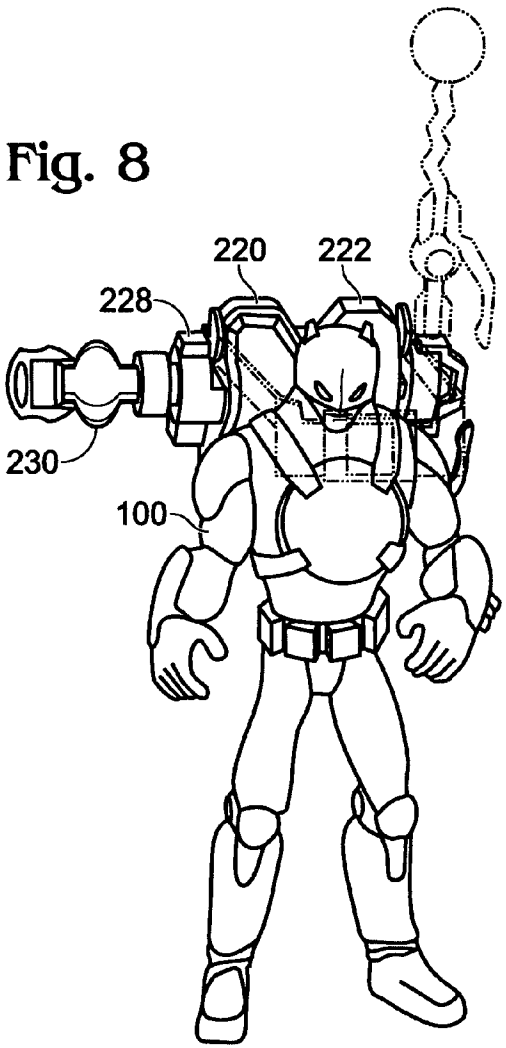
FIG. 8 is a front view of a toy figure with an example of an accessory attached to a back of a toy figure.

Housing 222 may include one or more actuators 231 configured to provide one or more inputs to an electrical system of the accessory (further discussed below), as shown in FIG. 9. The mechanical assembly may be operatively connected to the housing and may include an antenna 232, a face guard 233, and bias elements 234. The antenna may be configured to move between a retracted position (shown in solid lines in FIG. 9) and an extended position (shown in dashed lines in FIG. 9). Similarly, the face guard may be configured to move between a retracted position (shown in solid lines in FIG. 9) and an extended position (shown in dashed lines in FIG. 9). Bias elements 234 may operatively connect the antenna and/or the face guard to the housing to urge the antenna and/or the faceguard toward the extended position.

Securing mechanism 226 may include a hook 236, a latch 237, bias elements 238, a follower 242, and a bias element 244. The hook may be configured to move between a securing position (shown in FIG. 12) in which the antenna is held in the retracted position, and an unsecuring position (shown in FIG. 13) in which the antenna is free to move to the extended position. Similarly, the latch may be configured to move between a securing position (shown in FIG. 12) in which the face guard is held in the retracted position, and an unsecuring position (shown in FIG. 13) in which the face guard is free to move to the extended position.

Figure 10:
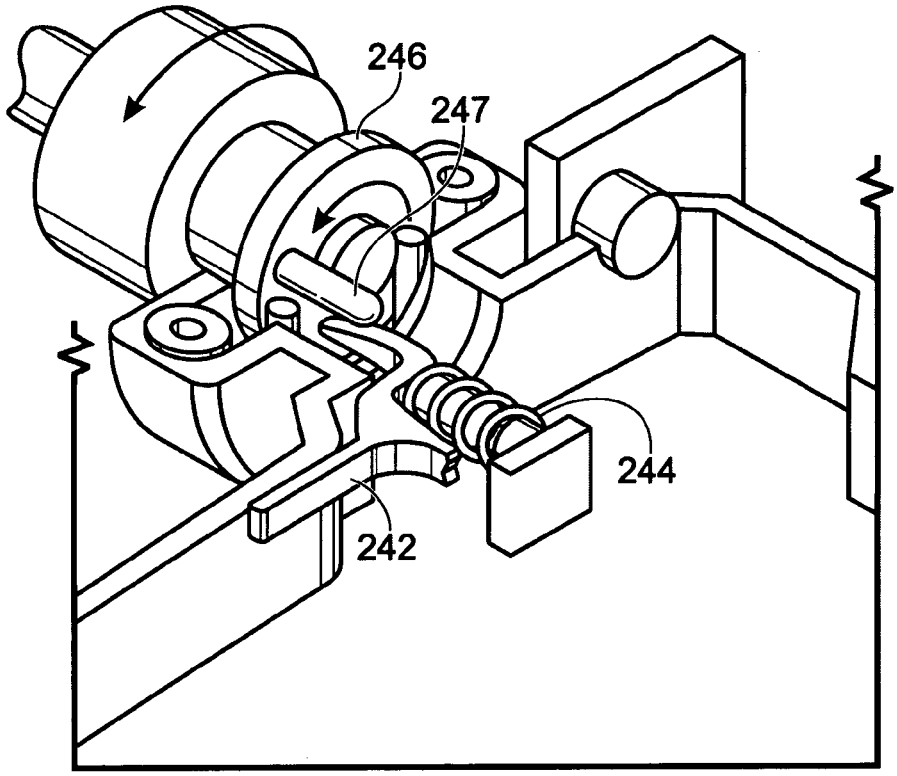
FIGS. 10-11 are partial isometric sectional views of a key receiver assembly engaging an actuator assembly of the accessory of FIG. 8.
Figure 11:
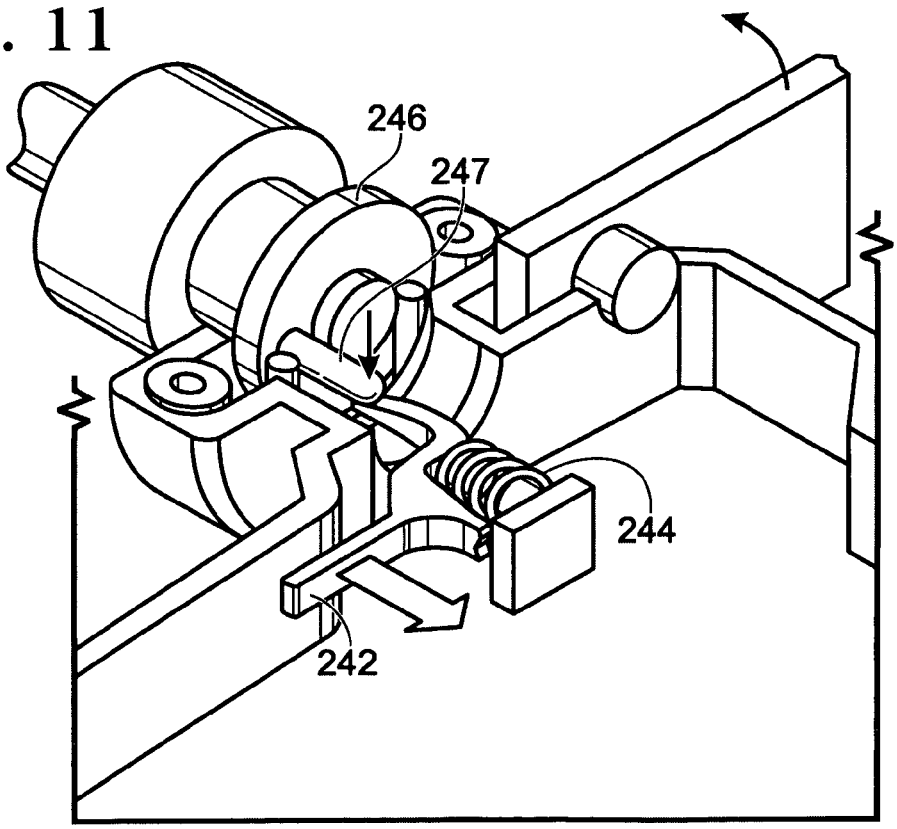
Figure 12:
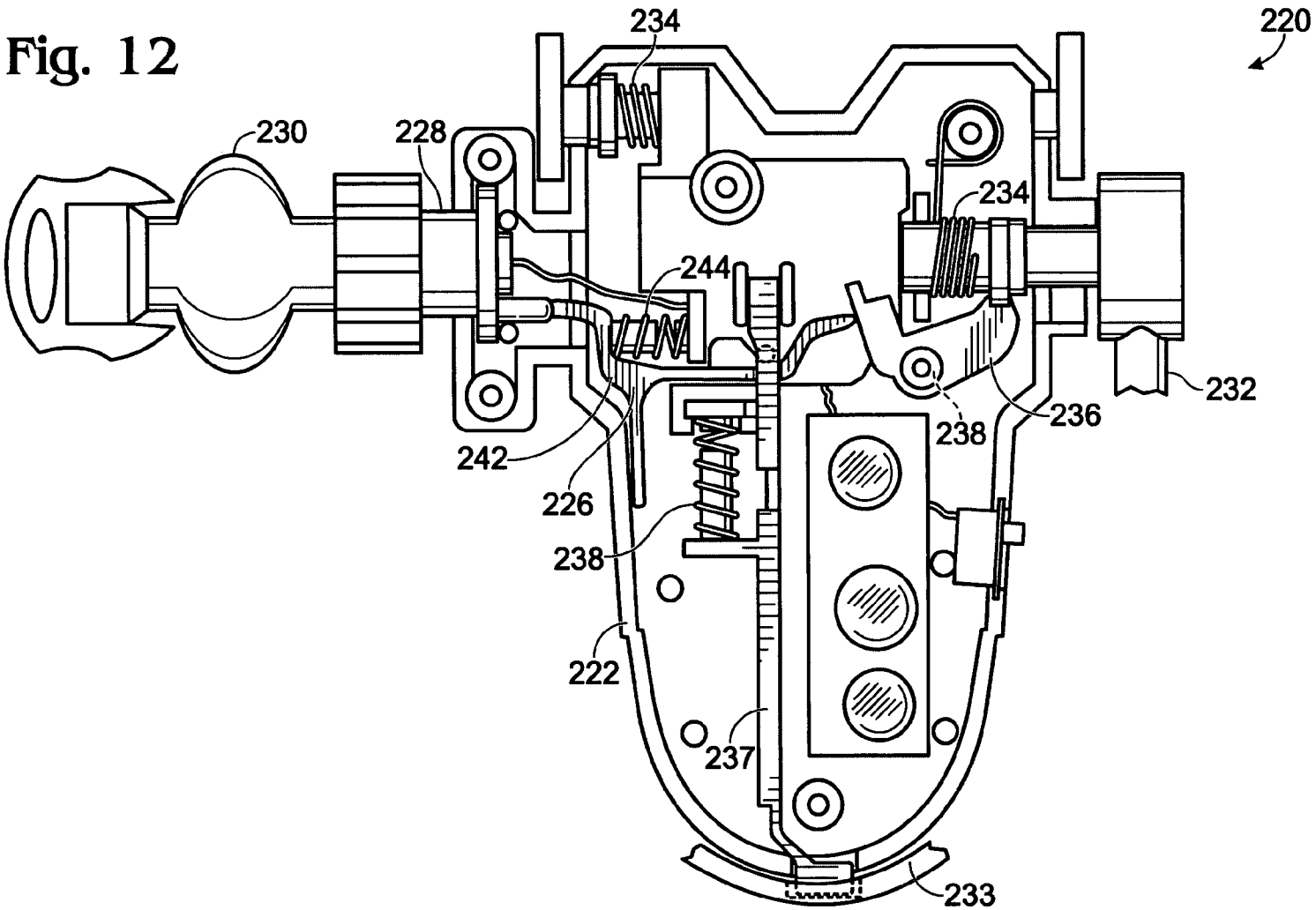
FIG. 12 is a front sectional view of the accessory of FIG. 8 showing a front half of the accessory with mechanical members in a first position.
Figure 13:
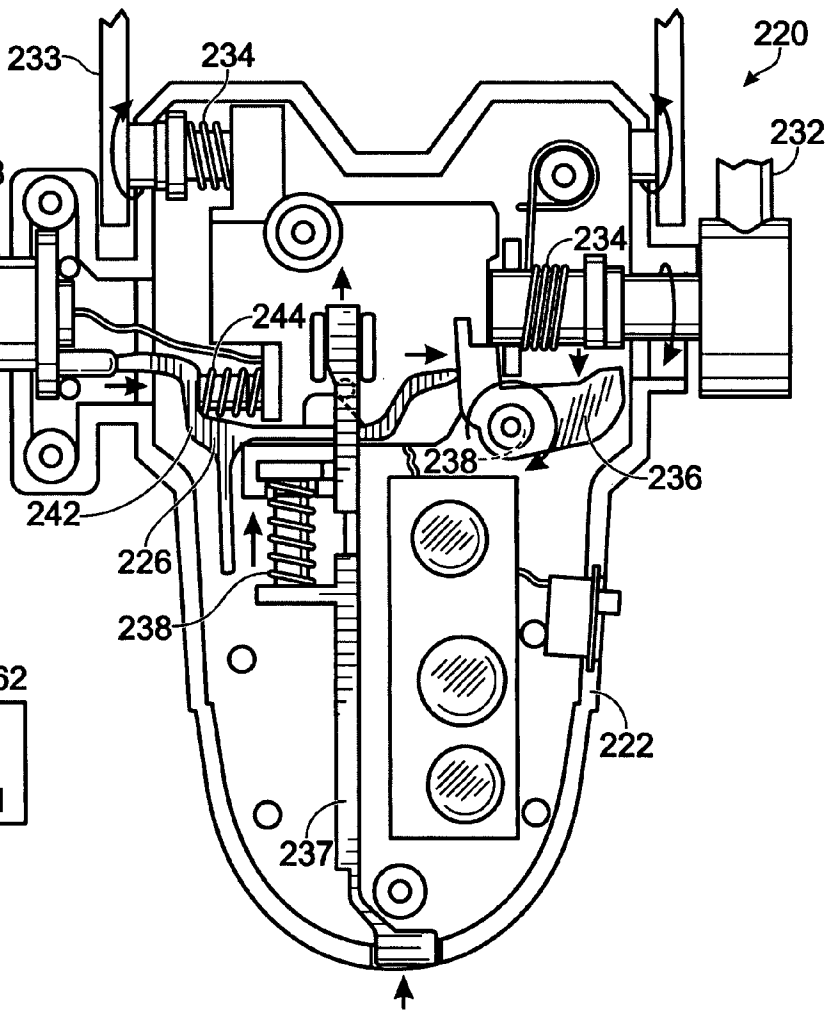
FIG. 13 is a front sectional view of the accessory of FIG. 8 showing the front half of the accessory with the mechanical members in a second position.
Figure 14:
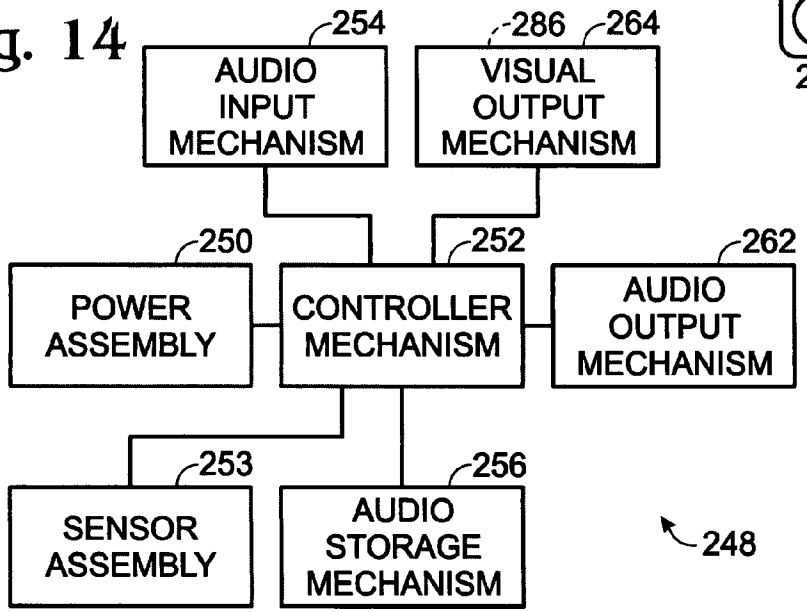
FIG. 14 is a schematic view of an electrical system of the accessory of FIG. 8.
Figure 15:
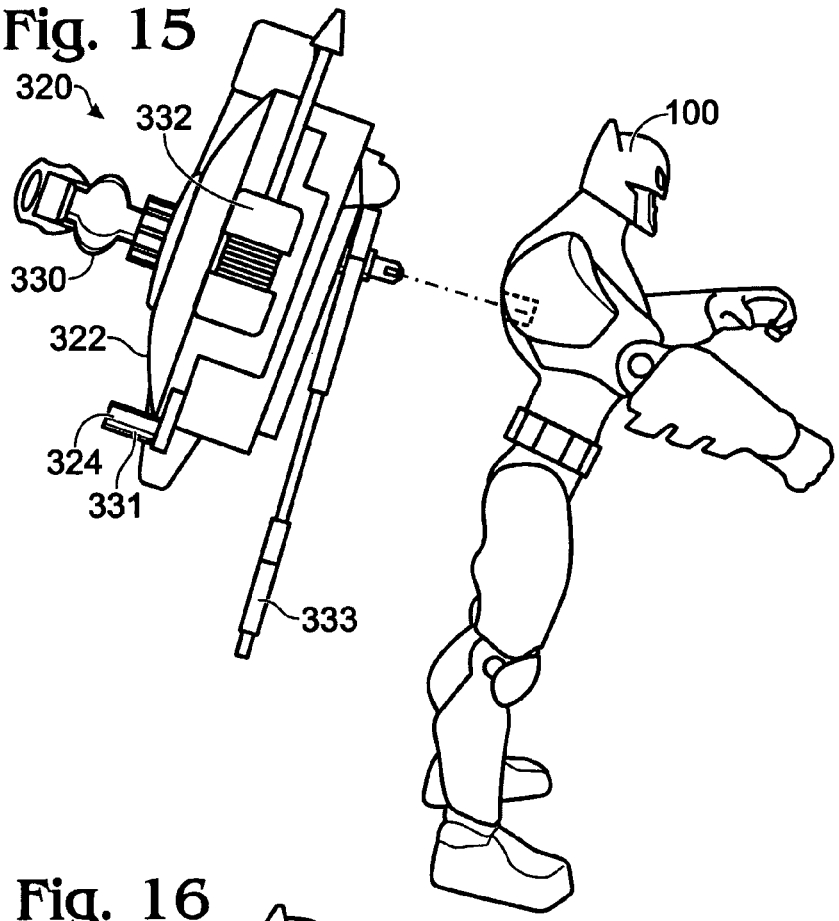
FIG. 15 is a side view of a toy figure with another example of an accessory with mechanical members in a first position.
Figure 16:
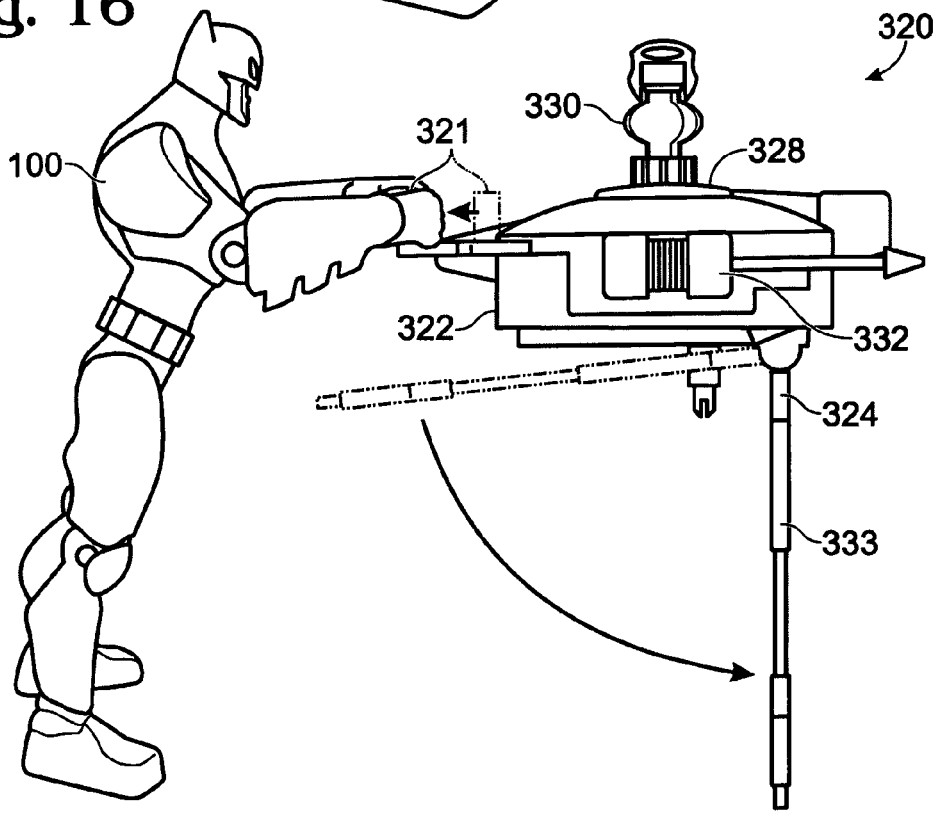
FIG. 16 is a side view of the toy figure and the accessory of FIG. 15 with the mechanical members in a second position.
Figure 18:
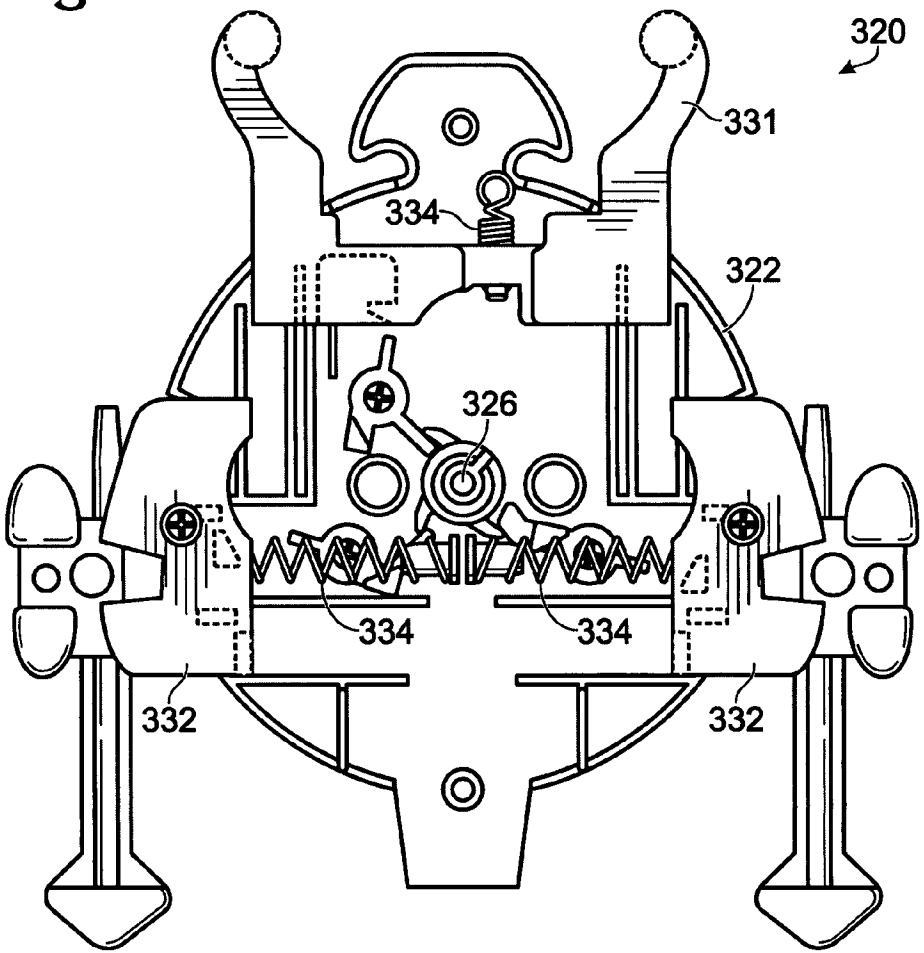
FIG. 18 is a top sectional view of the accessory of FIG. 15 showing a top half of the accessory with the mechanical members in a second position.
Figure 17:
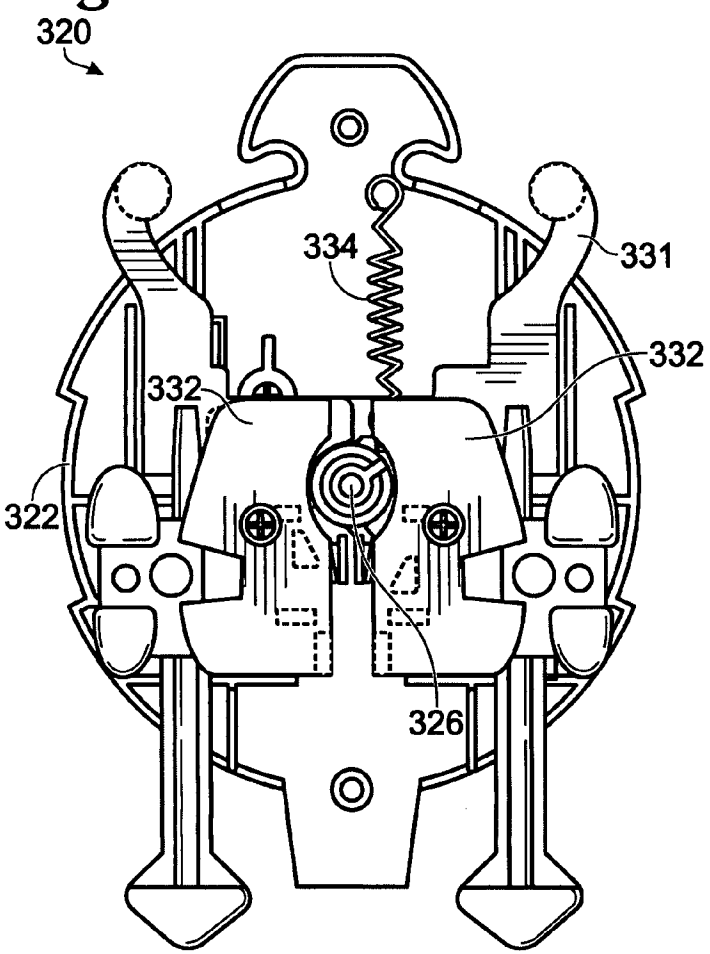
FIG. 17 is a top sectional view of the accessory of FIG. 15 showing a top half of the accessory with mechanical members in a first position.
Figure 21:
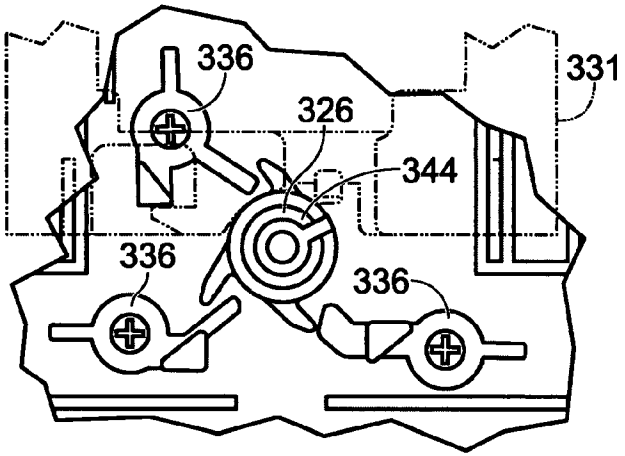
FIG. 21 is a partial view of the accessory of FIG. 17 showing the actuator assembly and a securing mechanism in a securing position for a mechanical member.
Figure 22:
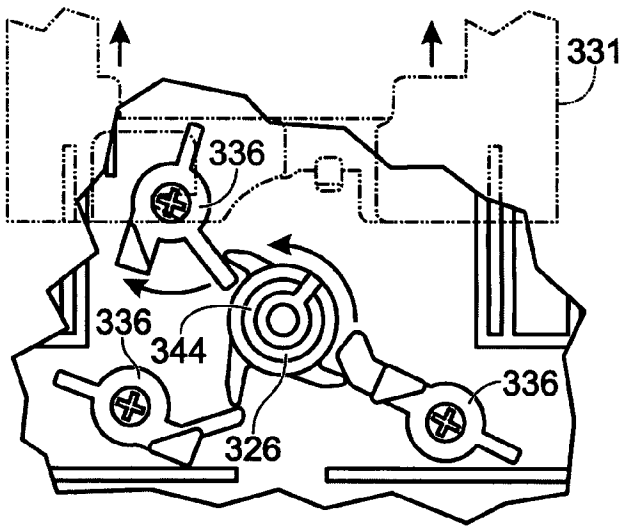
FIG. 22 is a partial view of the accessory of FIG. 17 showing the actuator assembly and the securing mechanism in an unsecuring position for the mechanical member.
Figure 19:
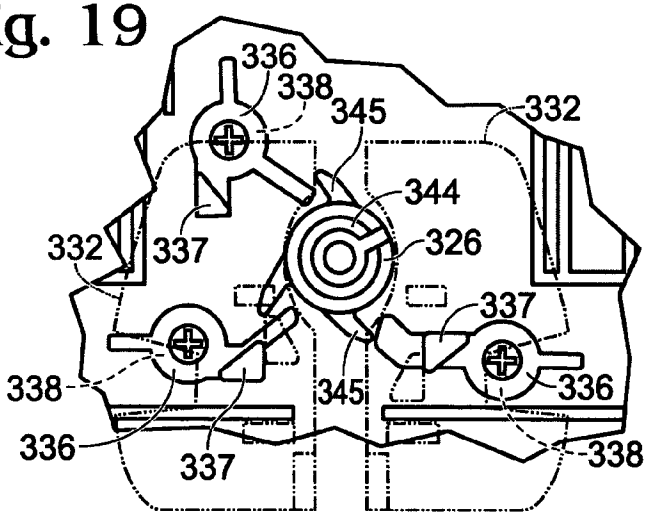
FIG. 19 is a partial view of the accessory of FIG. 17 showing an actuator assembly and securing mechanisms in a securing position for two mechanical members.
Figure 20:
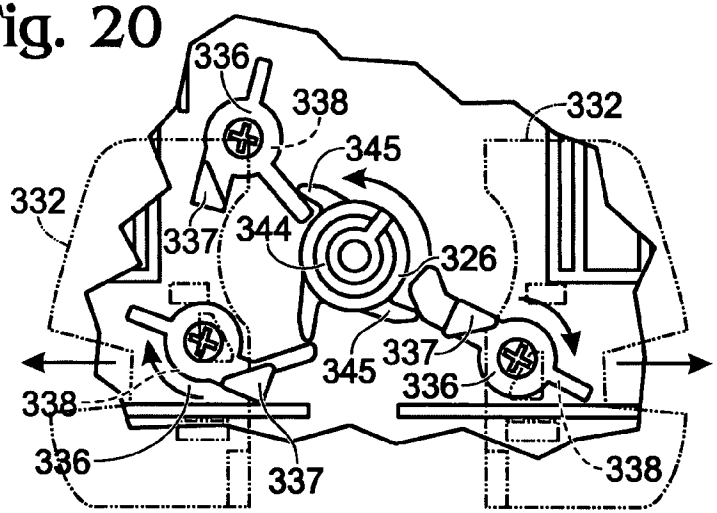
FIG. 20 is a partial view of the accessory of FIG. 17 showing the actuator assembly and the securing mechanisms in an unsecuring position for the two mechanical members.
Figure 24:
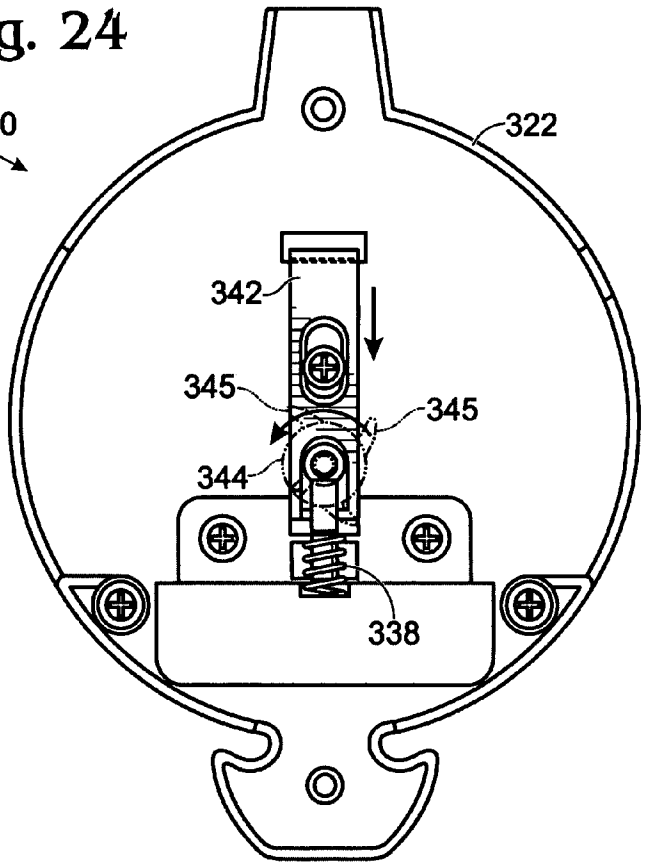
FIG. 24 is a top sectional view of the accessory of FIG. 15 showing the bottom half of the accessory with the securing mechanism in an unsecuring position for the mechanical member.
Figure 23:
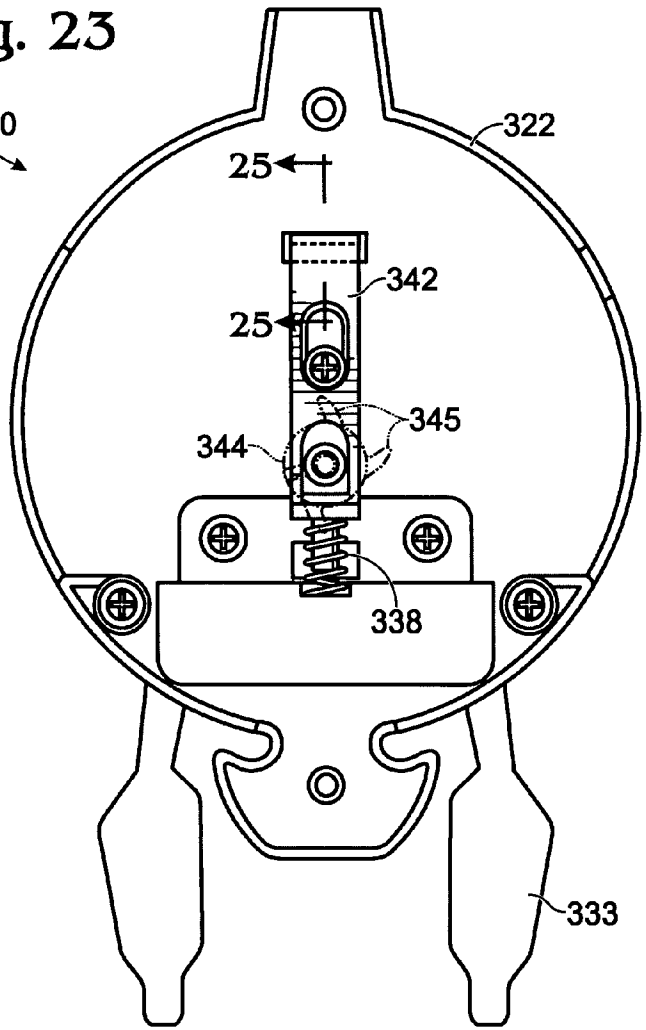
FIG. 23 is a top sectional view of the accessory of FIG. 15 showing a bottom half of the accessory with a securing mechanism in a securing position for a mechanical member.
Figure 27:
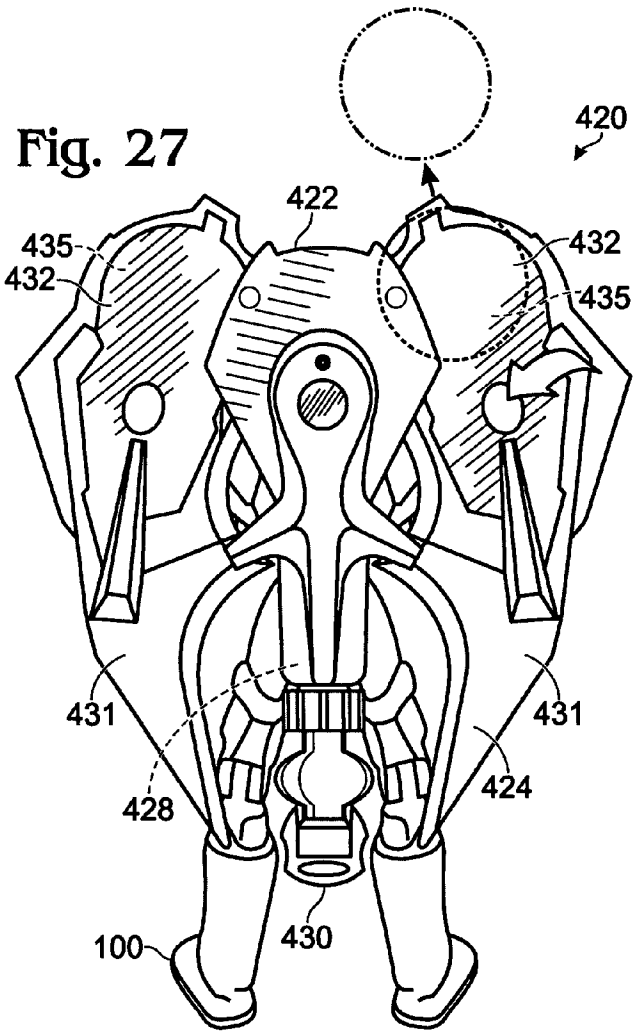
FIG. 27 is a front view of another example of an accessory attached to a toy figure showing projectile launchers and mechanical members in a first position.
Figure 25:
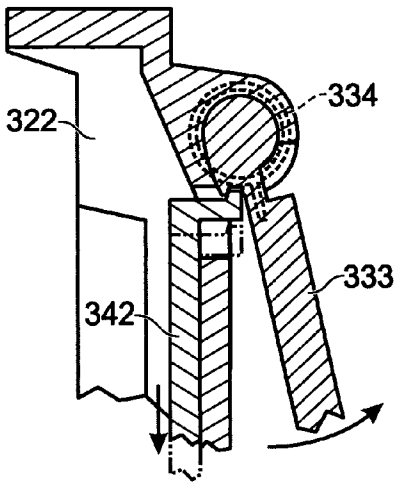
FIG. 25 is a partial sectional view of the accessory of FIG. 15 taken along lines 25-25 on FIG. 23 showing the securing mechanism and the mechanical member.
Figure 26:
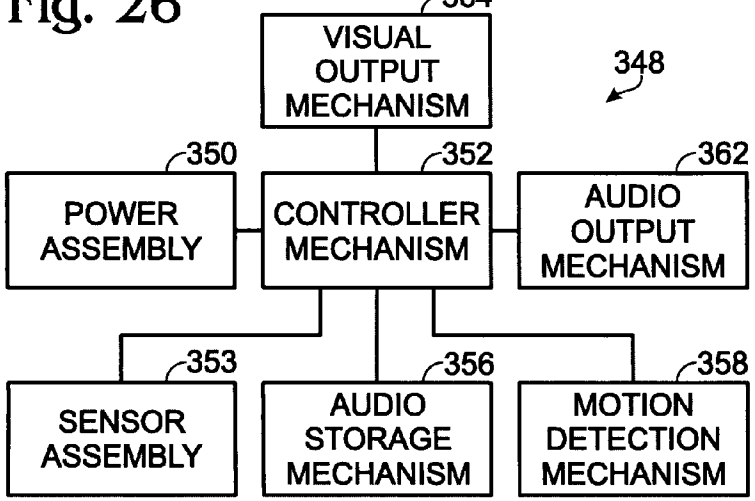
FIG. 26 is a schematic view of an electrical system of the accessory of FIG. 15.
Figures 28, 29:
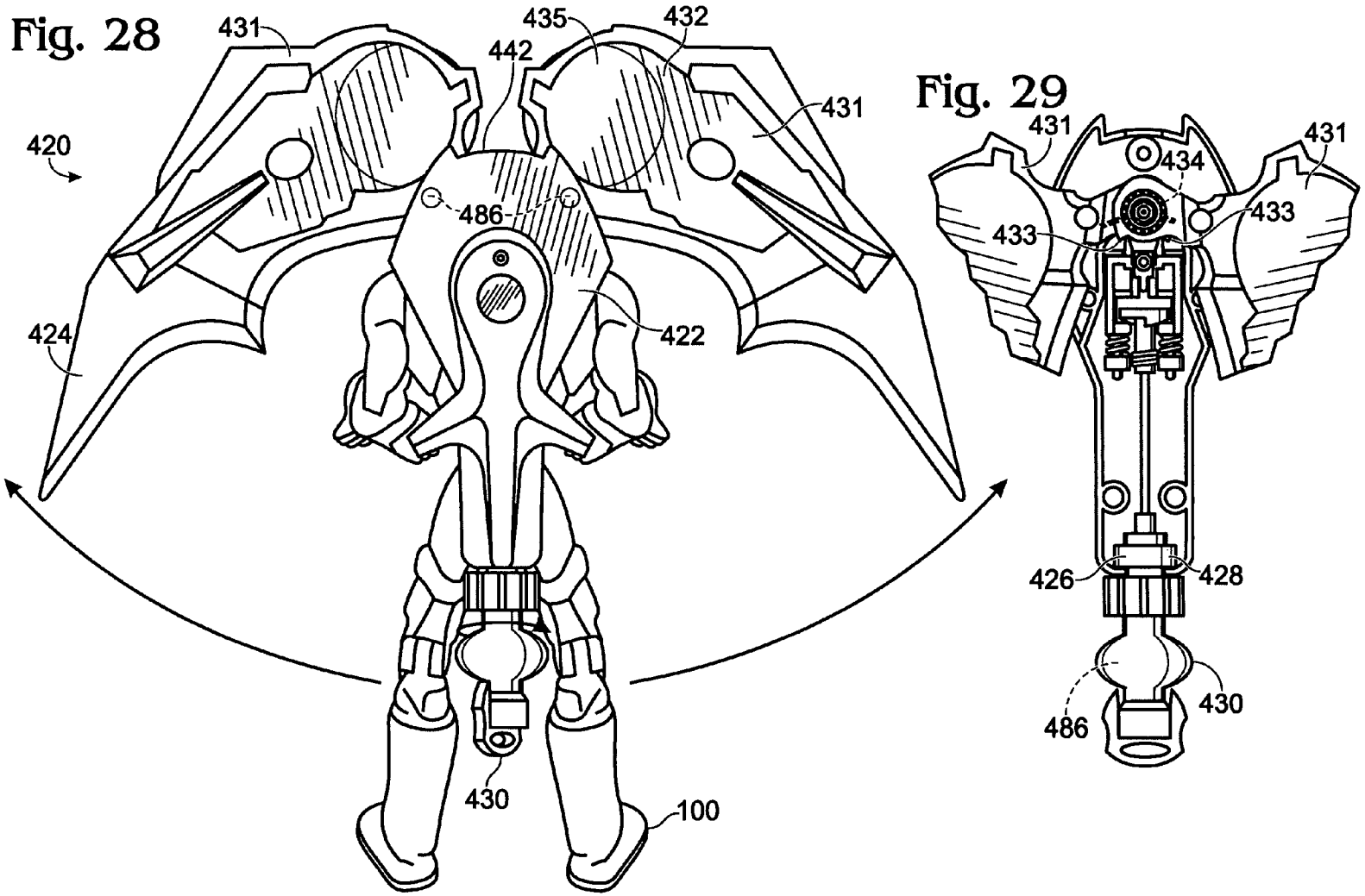
FIG. 28 is a front view of the accessory of FIG. 27 showing the mechanical members in the second position.
FIG. 29 is a front partial sectional view of the accessory of FIG. 27 showing a front half of the accessory with a key, a key receiver assembly, an actuator assembly, and a securing mechanism.
Figure 31:
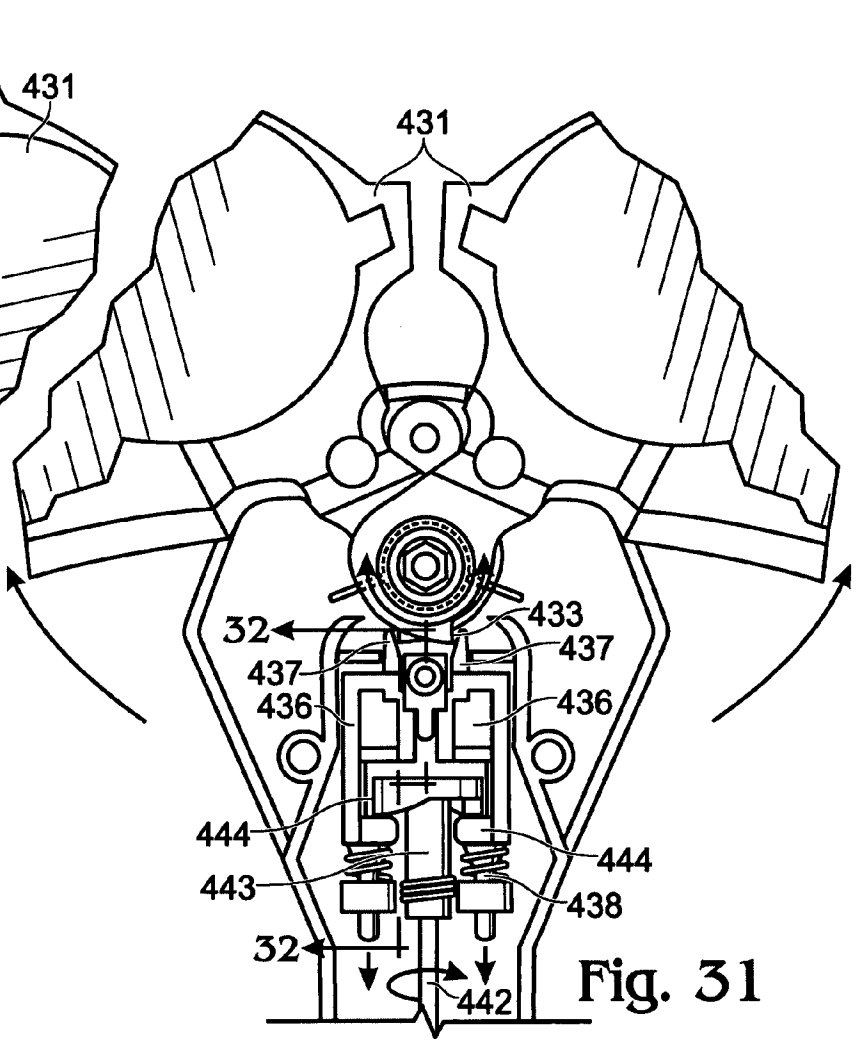
FIG. 31 is a partial view of the accessory of FIG. 29 showing the securing members of the securing mechanism in an unsecuring position.
Figure 30:
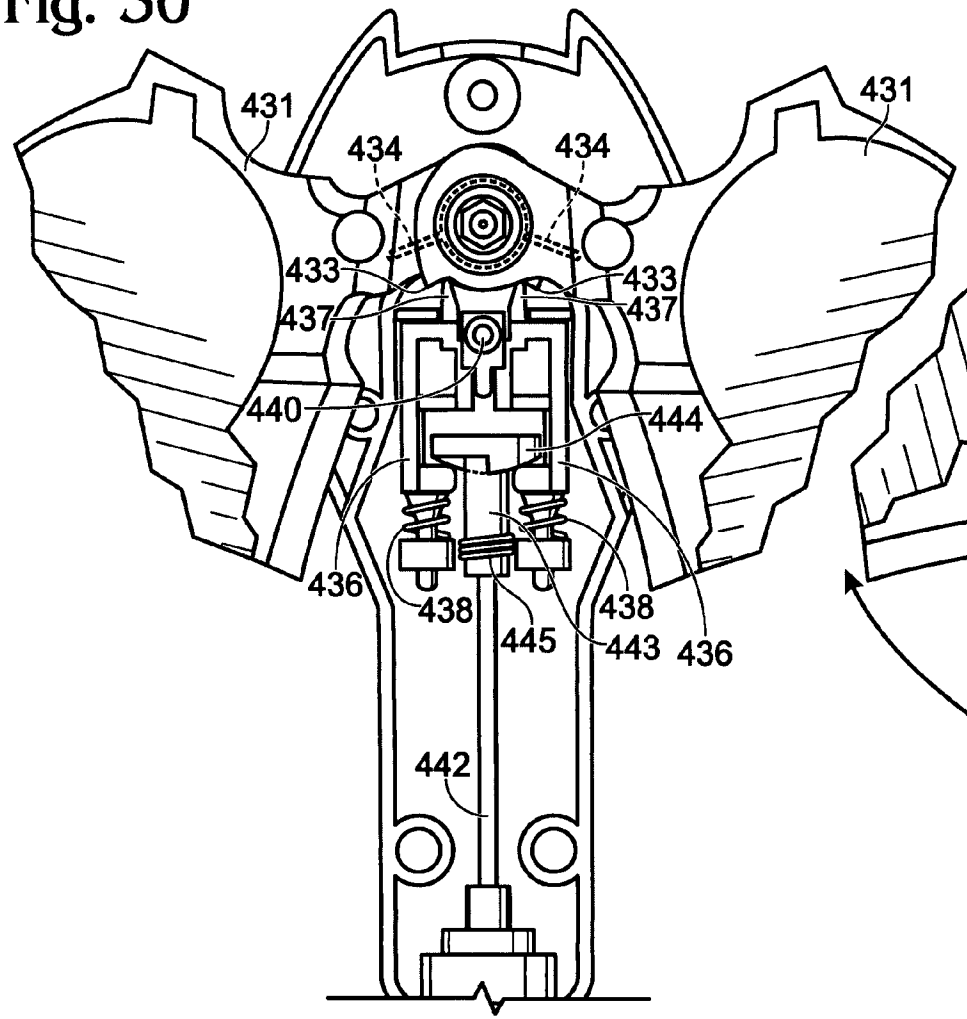
FIG. 30 is a partial view of the accessory of FIG. 29 showing securing members of the securing mechanism in a securing position.

Bias elements 238 may operatively connect the hook and the latch to the housing, and may urge the hook and the latch to the securing position. The follower may be configured to translate movement of the key in the key receiver assembly to movement of the key and latch between the securing and unsecuring positions. Bias element 244 may be configured to urge the follower away from the hook and the latch. Key receiver assembly 228 may include a key receptacle 246 having a protruding member 247, as shown in FIGS. 10-11. The key receptacle may be configured to be moved via the key such that the protruding member contacts follower 242 and moves the follower, which moves the key and latch between the securing and unsecuring positions.

Accessory 220 also may include an electrical system 248, which may include a power assembly 250, a controller mechanism 252, a sensor assembly 253, an audio input mechanism 254, an audio storage mechanism 256, an audio output mechanism 262, and a visual output mechanism 264. Accessory 220 may be configured to selectively record one or more sounds via the audio input mechanism, selectively store the one or more sounds, and/or selectively playback the one or more sounds.

Sensor assembly 253 may be configured to detect when one or more of the actuators are actuated to provide input(s) to the controller mechanism. For example, the actuators may include a "record" button and a "playback" button.

Additionally, the visual output mechanism may include one or more lights 286 configured to be illuminated via the controller mechanism responsive, at least in part, to at least one of recording the one or more sounds, storing the one or more sounds, and playing back the one or more sounds. For example, the lights may simulate a lie detector to determine whether the person whose voice was recorded is telling the truth or telling a lie or a falsity. Moreover, one or more of the lights may be in the key and may illuminate when the leg is inserted into the key receptacle.

FIGS. 15-26 illustrate another example of accessory 20 generally indicated at 320 for toy figure 100. Unless otherwise indicated, the accessory may have at least some of the components of the accessory 20 discussed above. Accessory 320 may include a housing 322, a mechanical assembly 324, a securing mechanism 326, a key receiver assembly 328, and a key 330.

Mechanical assembly 324 may be operatively connected to the housing and may include handles 331, projectile launchers 332, a stand 333, and bias elements 334. The handles and the projectile launchers may be configured to move between a retracted position (shown in FIG. 17) and an extended position (shown in FIG. 18). Similarly, the stand may be configured to move between a retracted position (shown in FIG. 15 and in dashed lines in FIG. 16) in which accessory 320 may be attached to a receptacle of a back of the toy figure, and an extended position (shown in FIG. 16) in which the accessory may be upright by having the toy figure grasp the handles of accessory 320. Bias elements 334 may operatively connect handles, the projectile launcher, and/or the stand to the housing to urge the handles, the projectile launcher, and the stand toward the extended position.

Securing mechanism 326 may include pivoting members 336 having protruding portions 337, bias elements 338, a latch 342, a main member 344 having protruding portions 345. The pivoting members may be configured to move between a securing position (shown in FIG. 19 and FIG. 21) in which the handles and the projectile launchers are held in the retracted position (via the protruding portions 337 contacting protruding portions 335 of the handles and projectile launchers), and an unsecuring position (shown in FIGS. 20 and 22) in which the handles and the projectile launchers are free to move to the extended position.

Similarly, the latch may be configured to move between a securing position (shown in FIG. 23 and in solid lines in FIG. 25) in which the stand is held in the retracted position, and an unsecuring position (shown in FIG. 23 and in dashed lines in FIG. 25) in which the stand is free to move to the extended position. Bias elements 338 may operatively connect the pivoting members and the latch to the housing, and may urge the pivoting members and the latch to the securing position. The main member may be configured to translate movement of the key in the key receiver assembly to movement of the pivoting members and the latch (via protruding portions 345 of the main member contacting the pivoting members and the latch) between the securing and unsecuring positions.

The securing mechanism also may include a bias element (not shown), which may urge the protruding portions away from the pivoting members and the latch. Key receiver assembly 328 may include a key receptacle 346 that may be configured to be moved via the key such the main member moves the pivot members and the latch between the securing and unsecuring positions.

Accessory 320 also may include an electrical system 348, which may include a power assembly 350, a controller mechanism 352, a sensor assembly 353, an audio storage mechanism 356, a motion detection mechanism 358, an audio output mechanism 362, and a visual output mechanism 364. Accessory 320 may be configured to detect a person and/or object moving in front of the accessory and to generate one or more sounds (from the audio storage mechanism) and/or illuminate one or more lights responsive, at least in part, to the detection.

FIGS. 27-34 illustrate another example of accessory 20 generally indicated at 420. Unless otherwise indicated, the accessory may have at least some of the components of the accessory 20 discussed above. Accessory 420 may include a housing 422, a mechanical assembly 424, a securing mechanism 426, a key receiver assembly 428, and a key 430.

Mechanical assembly 424 may include wings 431 and bias elements 434. The wings may be pivotally connected to the housing and may include projectile launchers 432, notches 433, and lenses 435. The wings may be configured to move between a retracted position (shown in FIG. 27) in which the lenses are spaced from each other and the projectile launchers are free to eject projectiles, and an extended position (shown in FIG. 28) in which the lenses are adjacent to each other allowing a user to look through the lenses and the projectile launcher are obstructed from ejecting the projectiles. Bias elements 434 may operatively connect the wings to the housing, and may urge the wings toward the extended position.

Securing mechanism 426 may include latches 436 having protruding portions 437, bias elements 438, a bypass pin assembly 440, a shaft 442 having a head 443 with protruding portion 444, and a bias element 445. The latches may be configured to move between a securing position (shown in FIGS. 29-30) in which the wings are held in the retracted position (via the protruding portions 437 contacting notches 433), and an unsecuring position (shown in FIG. 31) in which the wings are free to move to the extended position. Bias elements 438 may operatively connect the latches to the housing, and may urge the latches to the securing position.

Shaft 442 may be configured to translate movement of the key in the key receiver assembly to movement of the latches (via protruding portions 444 of head 443 of the shaft contacting the latches) between the securing and unsecuring positions. Bias element 445 may urge head 443 such that protruding portion 444 is moved away the latches. Key receiver assembly 428 may include a key receptacle 446 that may be configured to be moved via the key such the shaft moves the latches between the securing and unsecuring positions, which moves the wings between the extended and retracted positions.

Figure 32:
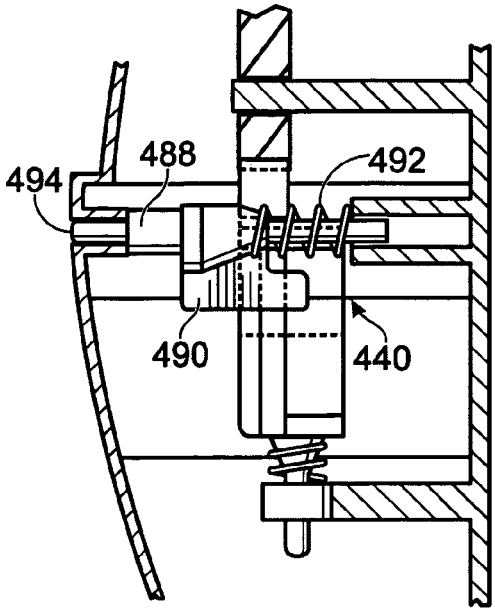
FIG. 32 is a partial sectional view of the accessory of FIG. 27 taken along lines 32-32 on FIG. 31 showing a bypass mechanism in an unbypassed position.
Figure 33:
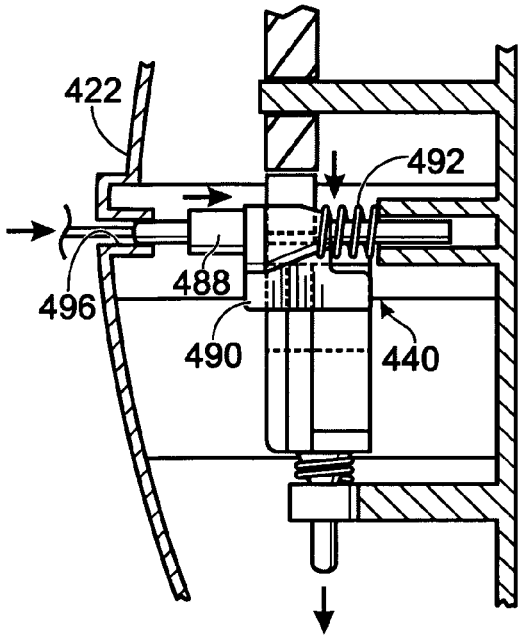
FIG. 33 is a partial sectional view of the accessory of FIG. 32 showing the bypass mechanism in a bypassed position.
Figure 34:
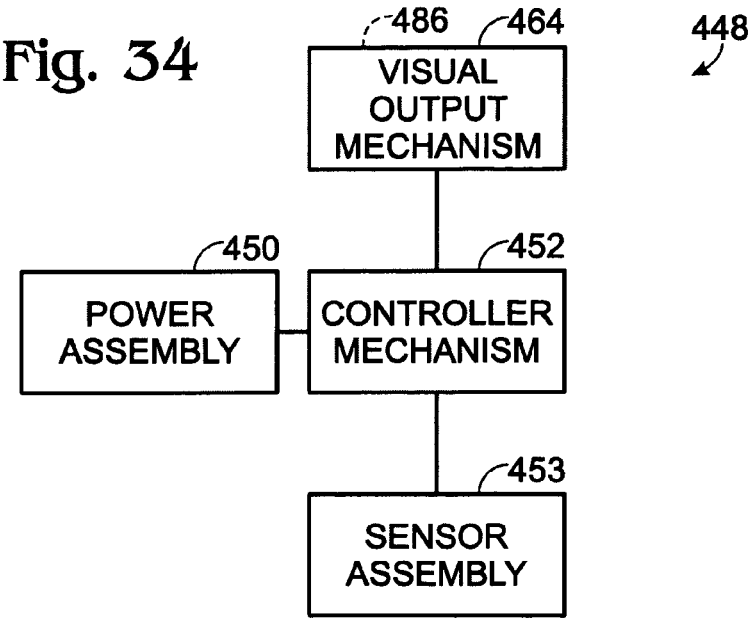
FIG. 34 is a schematic view of an electrical system of the accessory of FIG. 27.

Bypass pin assembly 440 may be configured to move the latches between the securing and unsecuring positions independent of the shaft. The bypass pin assembly may include a bypass pin 488 having a protruding portion 490, and a bias element 492. The protruding portion of the bypass pin contacts the latches and moves the latches to the unsecuring position. Bias element 492 urges the bypass pin away from the latches to allow the latches to move to the securing position. An end portion 494 of the bypass pin may be accessible through an opening 496 of housing 422. The end portion may be flushed to the opening of the accessory, as shown in FIG. 32, such that a sharp object or tool may be required to activate the bypass pin.

Accessory 420 also may include an electrical system 448, which may include a power assembly 450, a controller mechanism 452, a sensor assembly 453, and a visual output mechanism 464. The visual output mechanism may include one or more lights 486 located in the key and adjacent the lenses. The lights adjacent the lenses may be used with the lenses (when the wings are in the extended position) to simulate night vision.

FIGS. 35-38 illustrate another example of accessory 20 generally indicated at 520. Unless otherwise indicated, the accessory may have at least some of the components of the accessory 20 discussed above. Accessory 520 may include a housing 522, a mechanical assembly 524, a securing mechanism 526, a key receiver assembly 528, and a key 530.

Housing 522 may include cavities 531 to receive various members of the mechanical assembly. Mechanical assembly 524 may include a microphone 532 and an earphone 533. The microphone and the earphone may be configured to be inserted into the cavities of the housing, as shown in FIGS. 35-36.

Figure 37:
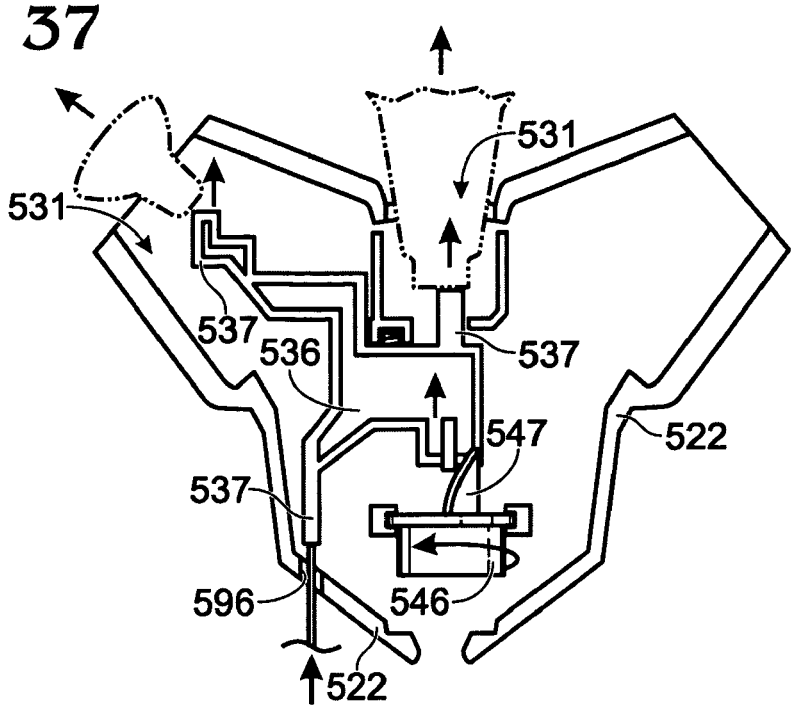
FIG. 37 is a front partial sectional view of the accessory of FIG. 35 shown without a key and showing the front half with securing members in an unsecuring position.
Figure 38:
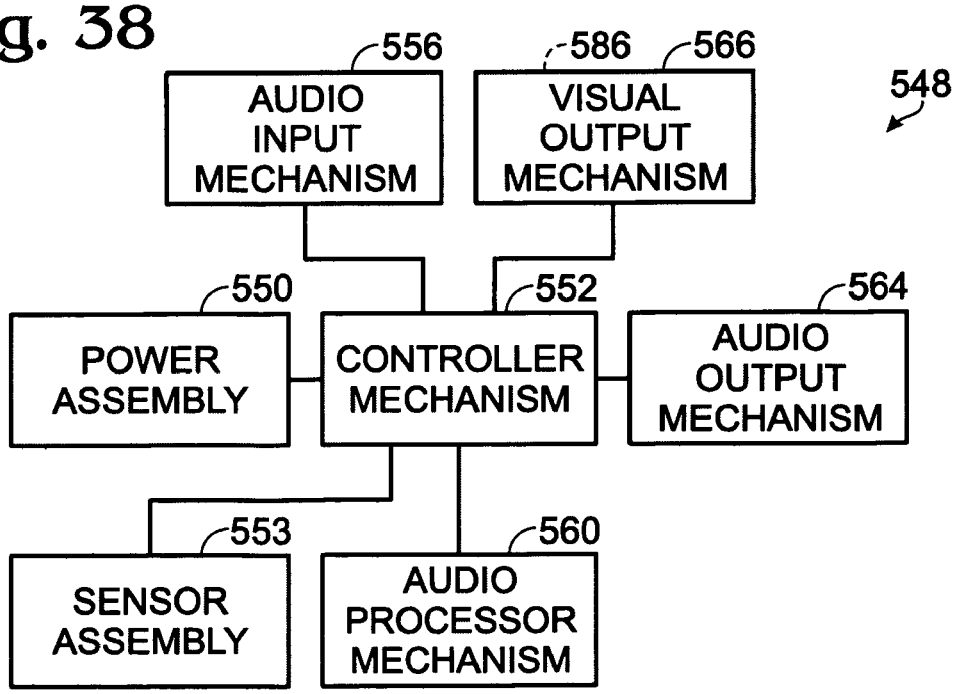
FIG. 38 is a schematic view of an electrical system of the accessory of FIG. 35.

Securing mechanism 526 may include a follower 536 and a bias element 538. The follower may be configured to move between a securing position in which the microphone and earphone are maintained within the cavities, and an unsecuring position in which the microphone and earphone are moved out of the cavities. Follower 536 may include protruding portions 537 to move the microphone and earphone out of the cavities and to provide a bypass pin 588. An end portion 594 of the bypass pin may be accessible through an opening 596 of housing 522. The end portion may be flushed to the opening of the accessory such that a sharp object or tool may be required to activate the bypass pin, as shown in FIG. 37.

Key receiver assembly 528 may include a key receptacle 546 having a protruding member 547. The key receptacle may be configured to be moved via the key such that the protruding member contacts follower 536 and moves the follower, which moves the microphone and earphone out of the cavities.

Accessory 520 also may include an electrical system 548, which may include a power assembly 550, a controller mechanism 552, a sensor assembly 553, an audio input mechanism 556, an audio processor mechanism 560, an audio output mechanism 564, and a visual output mechanism 566: The electrical system may receive one or more sounds from the microphone. The one or more sounds may be processed (such as amplified in volume and/or other processing) and then generated through the earphone. Visual output mechanism 566 may include one or more lights 586, which may illuminate when the key is in the key receptacle.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. An accessory for a toy figure having at least one receptacle, comprising:

a housing configured to be selectively attached to the at least one receptacle of the toy figure;

an audio input mechanism operatively attached to the housing and configured to receive one or more sounds;

an audio processing mechanism configured to change a characteristic of the one or more sounds received from the audio input mechanism, the characteristic being one or more of timbre, tone, formant, reverberation, and pitch;

an audio output mechanism configured to output the received one or more sounds with the changed characteristic from; and an optical assembly operatively attached to the housing and including at least two lenses and at least one light adjacent each lens.

2. The accessory of claim 1, wherein the audio input mechanism includes at least one microphone.

3. The accessory of claim 2, wherein the audio output mechanism include at least one earphone.

4. The accessory of claim 1, further comprising an audio storage mechanism configured to store the one or more sounds received by the audio input mechanism.

5. The accessory of claim 1, further comprising a visual output mechanism having one or more lights and at least one controller configured to illuminate the one or more lights responsive, at least in part, to the sound processing mechanism processing the one or more sounds.

6. The accessory of claim 1, further comprising:

one or more batteries configured to provide electrical power to the audio input, processing, and output mechanisms;

a key including one or more lights; and a key receiver assembly in electrical communication with the one or more batteries, the key receiver assembly configured to receive the key and illuminate the one or more lights.

7. The accessory of claim 6, further comprising one or more mechanical members operatively connected to the housing and configured to move between a first position and a second position, wherein the key receiver assembly is configured to be moved at least by the key to move the one or more mechanical members between the first and second positions.

8. The accessory of claim 1, further comprising a motion detector mechanism operatively attached to the housing and configured to detect movement of an object in a detection zone, wherein the audio output mechanism is configured to output one or more sounds responsive, at least in part, to the motion detector mechanism detecting movement of the object.

9. An accessory for a toy figure having at least one receptacle, comprising:

a housing configured to be selectively attached to the at least one receptacle of the toy figure;

a motion detector mechanism operatively attached to the housing and configured to detect movement of an object in a detection zone;

an audio output mechanism configured to output one or more sounds responsive, at least in part, to the motion detector mechanism detecting movement of the object; and an optical assembly operatively attached to the housing and including at least two lenses and at least one light adjacent each lens.

10. The accessory of claim 9, further comprising a visual output mechanism having one or more lights and at least one controller configured to illuminate the one or more lights when movement of an object is detected by the motion detector mechanism.

11. The accessory of claim 9, further comprising one or more projectiles and at least one projectile launcher configured to selectively launch the one or more projectiles.

12. The accessory of claim 9, further comprising:

one or more batteries configured to provide electrical power to the motion detector and audio output mechanisms;

a key including one or more lights; and a key receiver assembly in electrical communication with the one or more batteries, the key receiver assembly configured to receive the key and illuminate the one or more lights.

13. The accessory of claim 9, further comprising an audio input mechanism operatively attached to the housing and configured to receive one or more sounds, and an audio processing mechanism configured to process the one or more sounds received from the audio input mechanism, wherein the audio output mechanism is configured to selectively output the processed one or more sounds from the audio processing mechanism.

14. An accessory for a toy figure having at least one receptacle, comprising:

a housing configured to be selectively attached to the at least one receptacle of the toy figure; and an optical assembly operatively attached to the housing, the optical assembly including two or more mechanical members each having at least one lens and at least one light adjacent each lens, wherein the two or more mechanical members are selectively movable between a deployed position in which the lenses are adjacent to each other, and a retracted position in which the lenses are spaced apart from each other.

15. The accessory of claim 14, further comprising one or more projectiles and at least one projectile launcher configured to selectively launch the one or more projectiles.

16. The accessory of claim 14, further comprising:

an audio input mechanism operatively attached to the housing and configured to receive one or more sounds;

an audio processing mechanism configured to process the one or more sounds received from the audio input mechanism; and an audio output mechanism configured to output the processed one or more sounds from the audio processing mechanism.

17. The accessory of claim 14, further comprising a motion detector mechanism operatively attached to the housing and configured to detect movement of an object, and an audio output mechanism configured to output one or more sounds when movement of the object is detected.

18. An accessory for a toy figure having at least one receptacle, comprising:

a housing configured to be selectively attached to the at least one receptacle of the toy figure; and an optical assembly operatively attached to the housing, the optical assembly including:

one or more projectiles, and two or more lenses, wherein at least one of the two or more lenses includes a projectile launcher configured to receive the one or more projectiles and to selectively launch the received one or more projectiles, the projectile launcher being positioned such that the one or more projectiles obstruct the view through the at least one of the two or more lenses when received by the projectile launcher.

19. The accessory of claim 18, wherein the optical assembly further includes two or more mechanical members each having one of the two or more lenses, the two or more mechanical members being selectively movable between a deployed position in which the two or more lenses are adjacent to each other, and a retracted position in which the two or more lenses are spaced apart from each other.

20. The accessory of claim 19, wherein the projectile launcher is obstructed from ejecting the one or more projectiles when the two or more mechanical members are in the deployed position, and are free to eject the one or more projectiles when the two or more mechanical members are in the retracted position.

* * * * *